US010488101B2

(12) United States Patent
Choi et al.

(10) Patent No.: US 10,488,101 B2
(45) Date of Patent: Nov. 26, 2019

(54) REFRIGERATOR

(71) Applicant: LG Electronics Inc., Seoul (KR)

(72) Inventors: Sungwoo Choi, Seoul (KR); Myunghwan Kim, Seoul (KR); Jisu Park, Seoul (KR); Hyunbum Kim, Seoul (KR); Jindong Kim, Seoul (KR); Jihyun Im, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/122,157

(22) Filed: Sep. 5, 2018

(65) Prior Publication Data

US 2019/0072316 A1 Mar. 7, 2019

Related U.S. Application Data

(63) Continuation of application No. 14/898,469, filed as application No. PCT/KR2014/005250 on Jun. 16, 2014.

(30) Foreign Application Priority Data

Jun. 14, 2013 (KR) ..... 10-2013-0068250
Oct. 18, 2013 (KR) ..... 10-2013-0124734

(51) Int. Cl.
*F25D 23/02* (2006.01)
*F25D 23/06* (2006.01)
(Continued)

(52) U.S. Cl.
CPC ..... *F25D 23/028* (2013.01); *E05D 11/0054* (2013.01); *F25D 11/00* (2013.01);
(Continued)

(58) Field of Classification Search
CPC .... F25D 23/028; F25D 23/062; F25D 23/025; F25D 2323/023; F25D 23/04;
(Continued)

(56) References Cited

U.S. PATENT DOCUMENTS 1,927,398 A 9/1933 Glasser
2,135,878 A 11/1938 Sekyra
(Continued)

FOREIGN PATENT DOCUMENTS

DE 102004045476 3/2006
EP 2587199 5/2013
(Continued)

OTHER PUBLICATIONS

International Search Report dated Nov. 2, 2014 for PCT/KR2014/005250, 2 pages.
(Continued)

*Primary Examiner* — Hiwot E Tefera
(74) *Attorney, Agent, or Firm* — Fish & Richardson P.C.

(57) ABSTRACT

Disclosed is a refrigerator. The refrigerator includes a cabinet (10) configured to define a first storage region in which food is stored, a door (20) rotatably connected to a first rotating shaft via a first hinge member (40) to open or close the first storage region, the first rotating shaft being located at the front of the cabinet (10), a gasket provided at the door (20) and a container (100) configured to define a second storage region, the second storage region being received in the first storage region, the container (100) being rotatably connected to a second rotating shaft via a second hinge member (200), the second rotating shaft being located at the door (20).

19 Claims, 16 Drawing Sheets

(51) Int. Cl.

| | |
|---|---|
| ***F25D 17/04*** | (2006.01) |
| ***F25D 11/00*** | (2006.01) |
| ***F25D 23/00*** | (2006.01) |
| ***E05D 11/00*** | (2006.01) |
| *F25D 23/04* | (2006.01) |

(52) U.S. Cl.
CPC ..... *F25D 17/04* (2013.01); *F25D 23/00* (2013.01); *F25D 23/025* (2013.01); *F25D 23/062* (2013.01); *E05D 2011/0072* (2013.01); *F25D 23/04* (2013.01); *F25D 2201/10* (2013.01); *F25D 2323/024* (2013.01)

(58) Field of Classification Search
CPC .... F25D 23/02; F25D 2323/024; F25D 11/00; F25D 17/04; F25D 23/00; F25D 2201/10; F25D 23/066; F25D 23/067; E05Y 2900/31; E05Y 2800/71; E05D 11/0054; E05D 2011/0072
USPC ..... 312/404, 405.1, 405, 291, 321.5, 292
See application file for complete search history.

(56) References Cited

U.S. PATENT DOCUMENTS

| | | | |
|---|---|---|---|
| 2,276,937 | A | 3/1942 | Arturo |
| 6,722,083 | B2 | 4/2004 | Herrmann et al. |
| 7,043,886 | B1 | 5/2006 | Chubb |
| 7,300,121 | B2 | 11/2007 | Diebold et al. |
| 8,147,015 | B2 | 4/2012 | Kim et al. |
| 9,175,901 | B2 | 11/2015 | Oh et al. |
| 9,510,696 | B2 | 12/2016 | Lee et al. |
| 9,651,295 | B2 | 5/2017 | Kim et al. |
| 9,702,615 | B1 | 7/2017 | Chartrand et al. |
| 2002/0021062 | A1* | 2/2002 | Hodges ..... F25D 23/085 312/401 |
| 2008/0303400 | A1 | 12/2008 | Kim |
| 2010/0147001 | A1 | 6/2010 | Kim et al. |
| 2011/0146324 | A1 | 6/2011 | Lee et al. |
| 2012/0062093 | A1 | 3/2012 | Lee et al. |
| 2012/0286639 | A1 | 11/2012 | Lee et al. |
| 2013/0026900 | A1 | 1/2013 | Oh et al. |
| 2013/0033163 | A1 | 2/2013 | Kang |
| 2013/0104590 | A1 | 5/2013 | Seo et al. |
| 2013/0169138 | A1 | 7/2013 | Im et al. |
| 2013/0169139 | A1 | 7/2013 | Jung et al. |
| 2013/0264932 | A1 | 10/2013 | Kim et al. |
| 2014/0132142 | A1 | 5/2014 | Kim et al. |
| 2014/0132146 | A1 | 5/2014 | Kim et al. |
| 2015/0233629 | A1 | 8/2015 | Choi et al. |
| 2016/0061511 | A1 | 3/2016 | Park et al. |
| 2017/0010040 | A1 | 1/2017 | Kim et al. |
| 2017/0191741 | A1 | 7/2017 | Jung et al. |

FOREIGN PATENT DOCUMENTS

| | | |
|---|---|---|
| JP | S439817 | 4/1968 |
| JP | H0666473 | 3/1994 |
| JP | 200-6038437 | 2/2006 |
| JP | 2011069612 | 4/2011 |

OTHER PUBLICATIONS

Extended European Search Report in European Application No. 14810677.6-1605/3008405, dated Jan. 2, 2017, 7 pages (with English translation).
Notice of Allowance in U.S. Appl. No. 16/122,074, dated Nov. 26, 2018, 8 pages.

* cited by examiner

[Fig. 1]
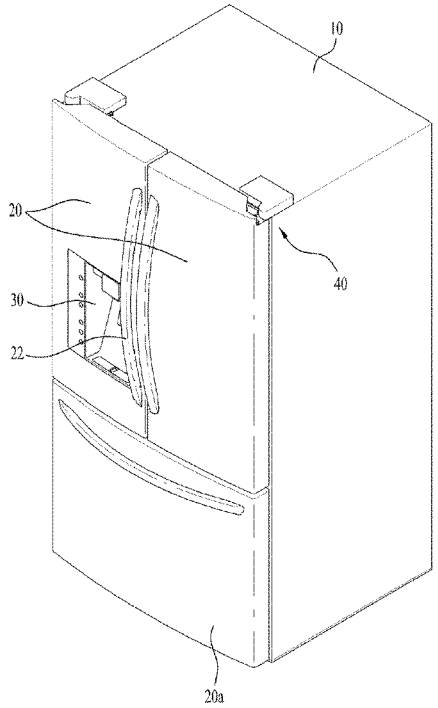
[Fig. 2]
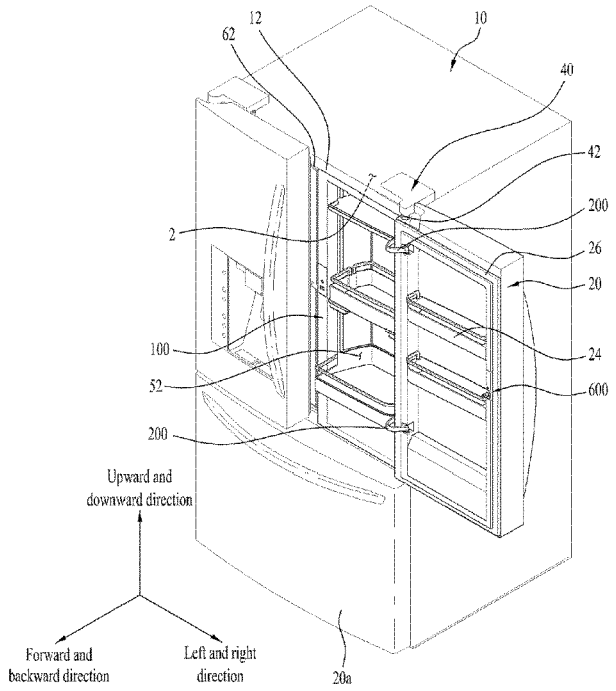

[Fig. 3]
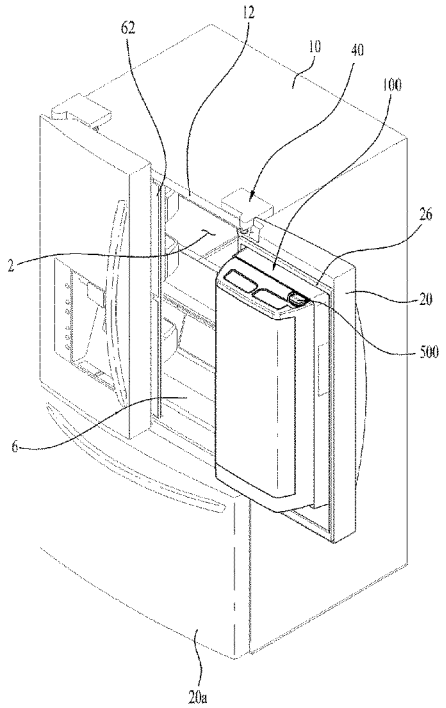
[Fig. 4]
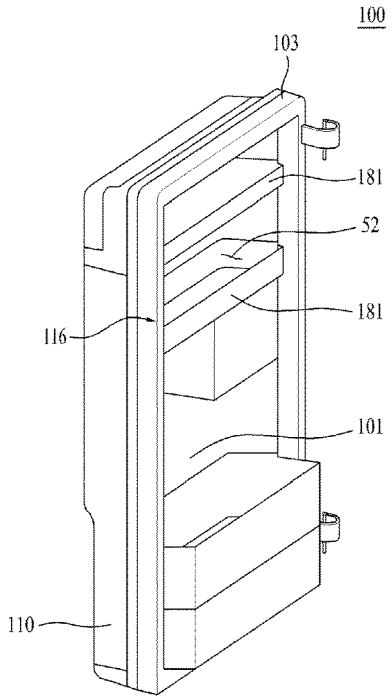

[Fig. 5]
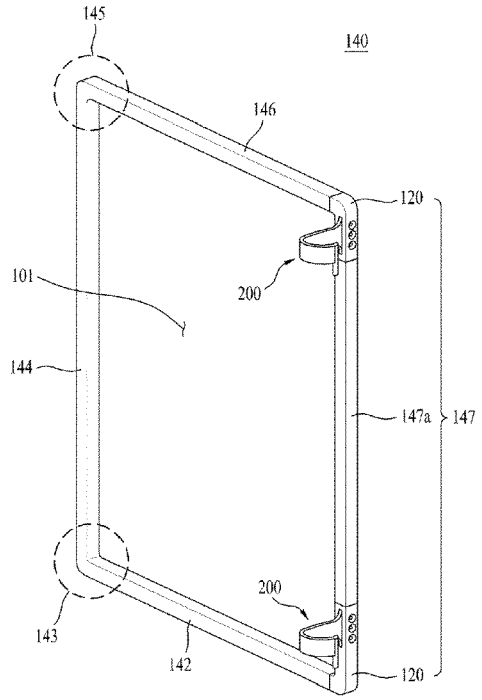
[Fig. 6]
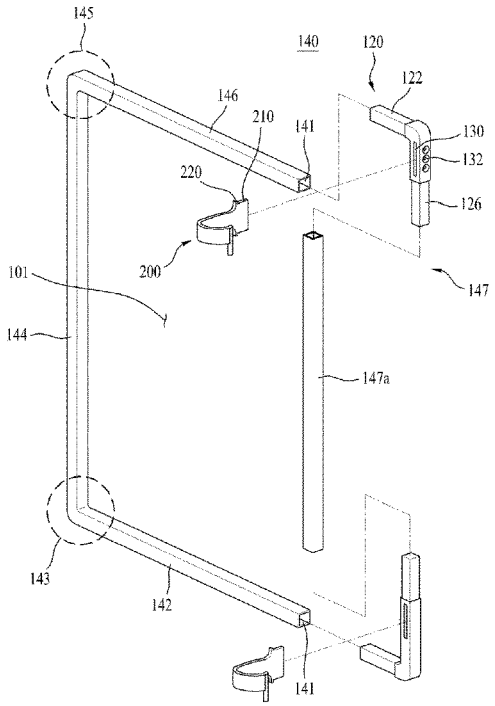

[Fig. 7]
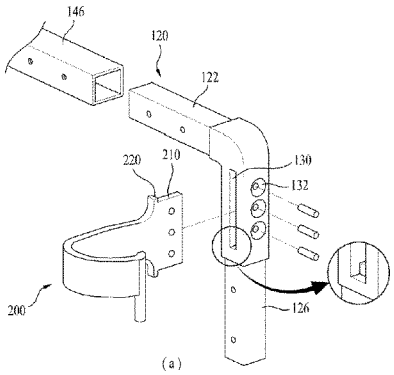
(a)
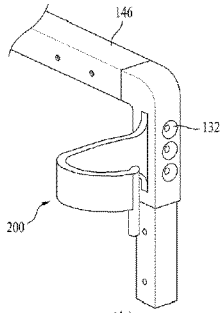
(b)
[Fig. 8]
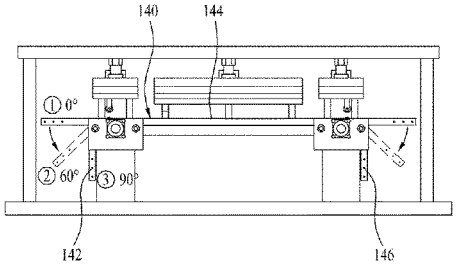
(a)
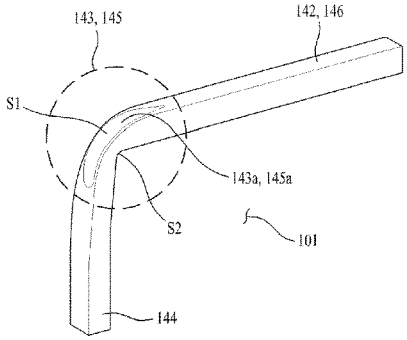
(b)

[Fig. 9]
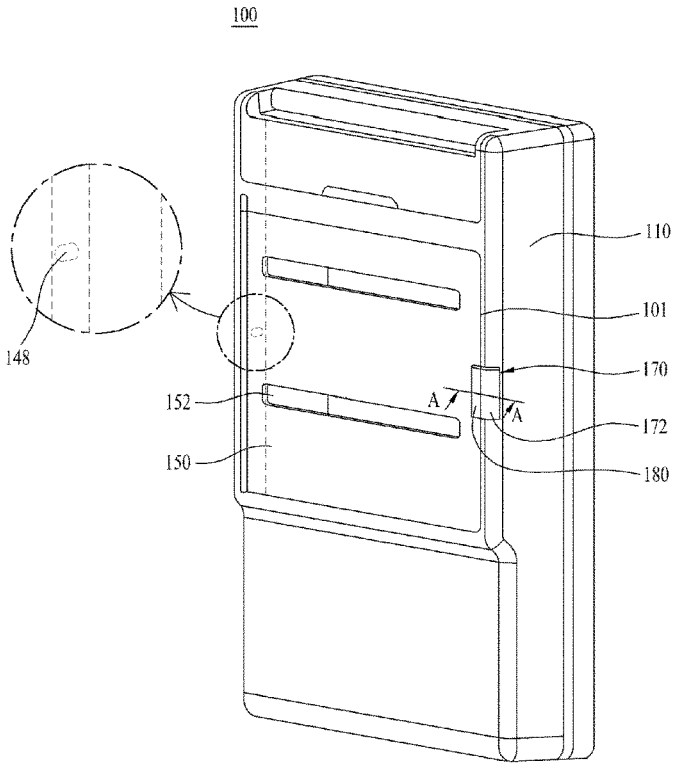
[Fig. 10]
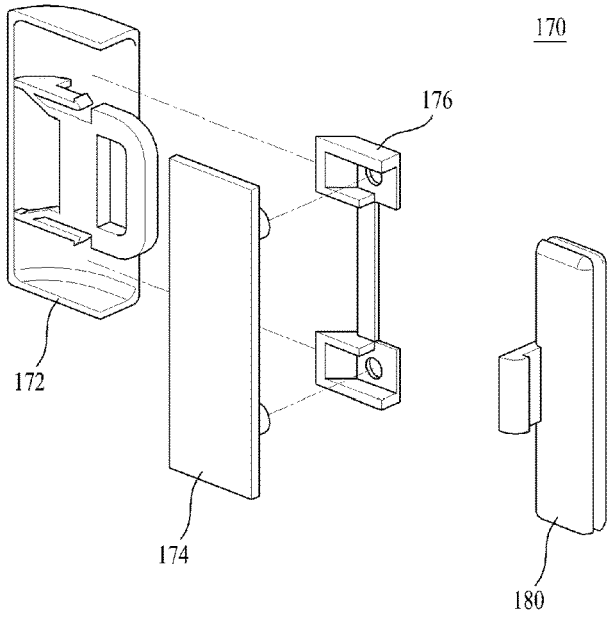

[Fig. 11]
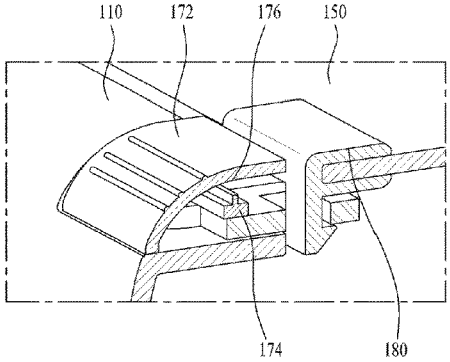
(a)
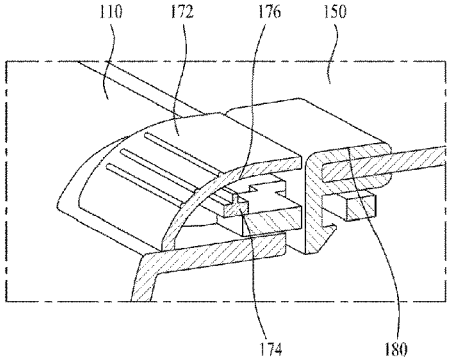
(b)
[Fig. 12]
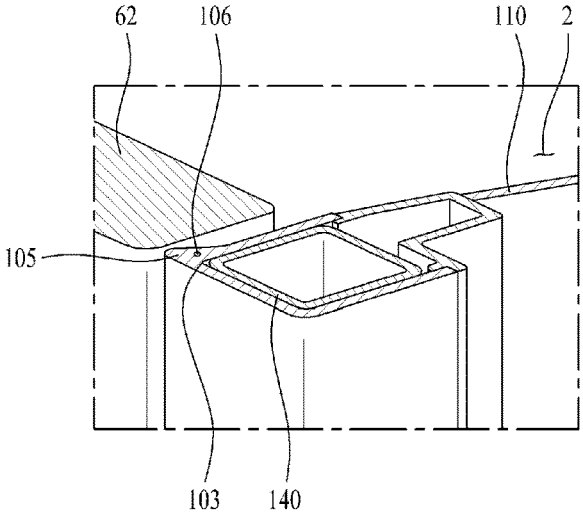

[Fig. 13]
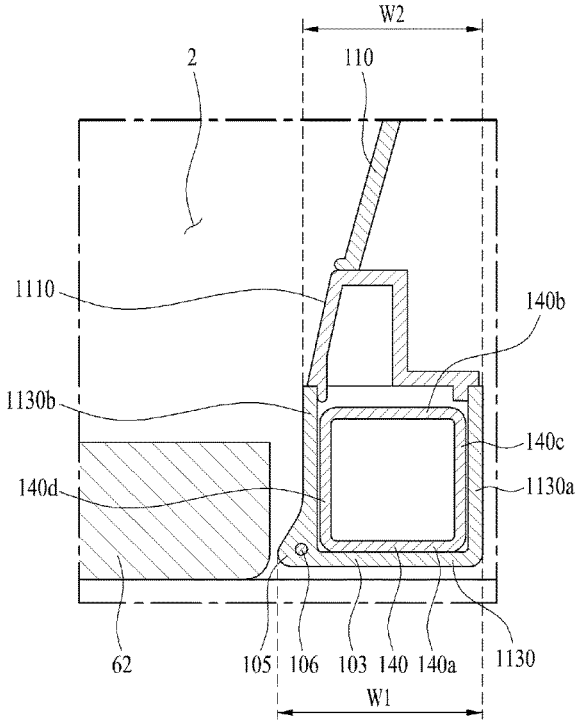
[Fig. 14]
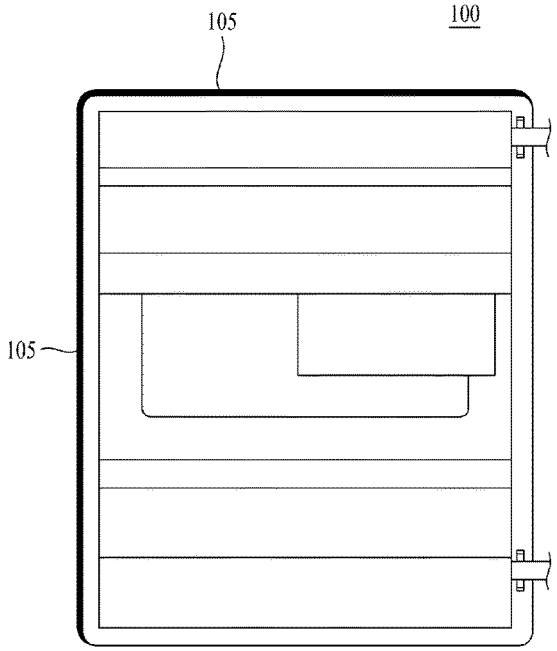

[Fig. 15]
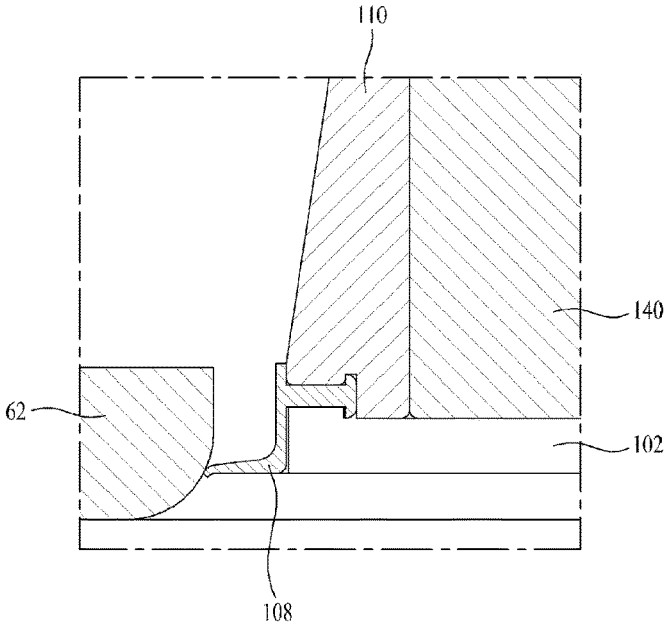
[Fig. 16]
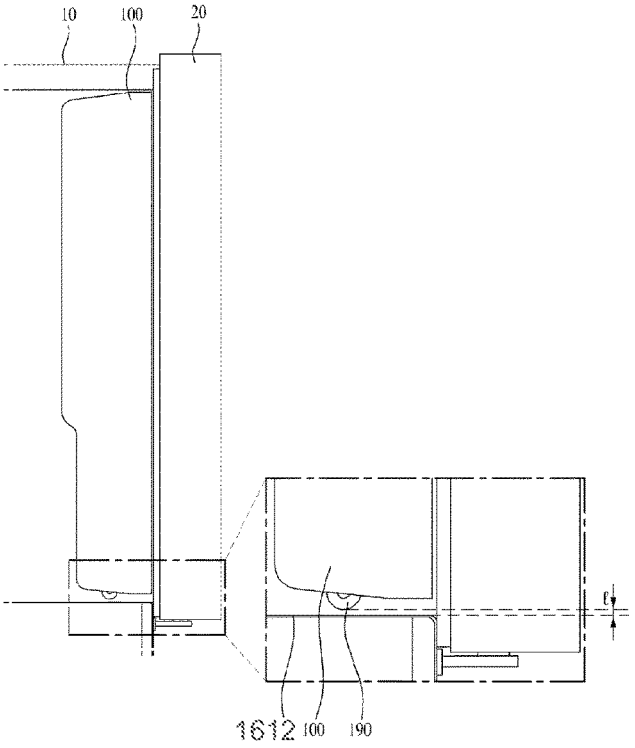

[Fig. 17]
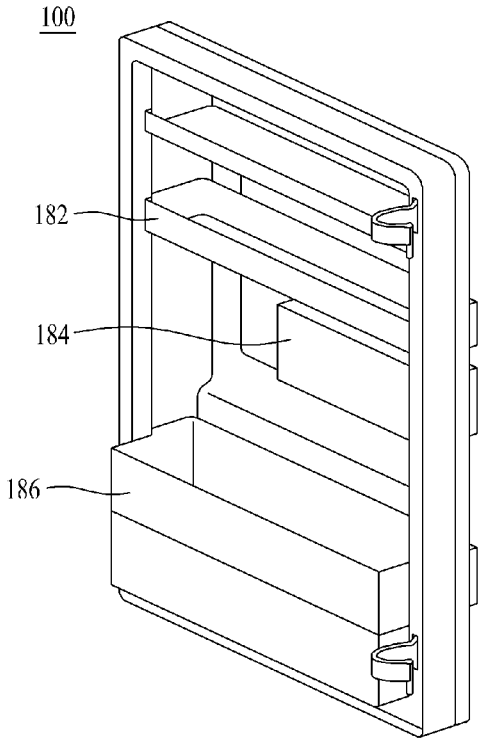
[Fig. 18]
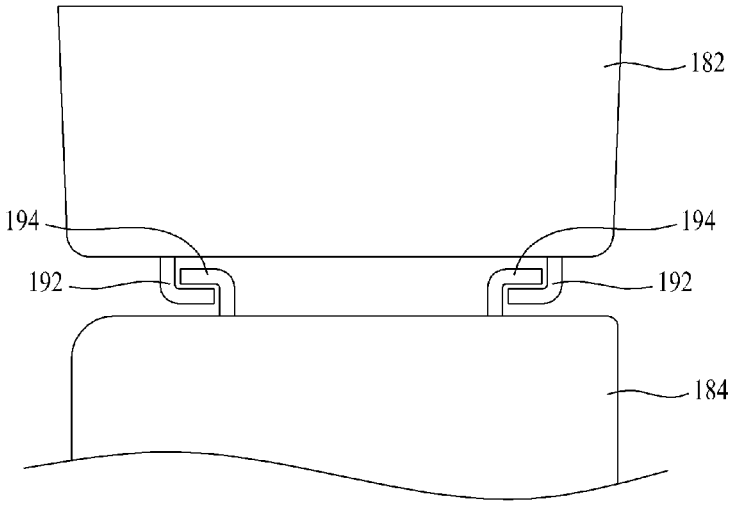

[Fig. 19]
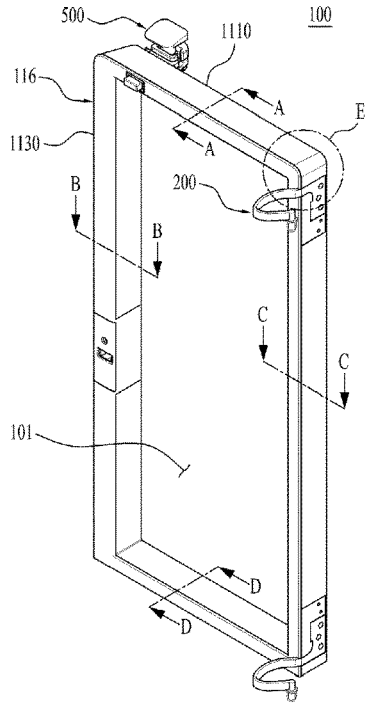
[Fig. 20]
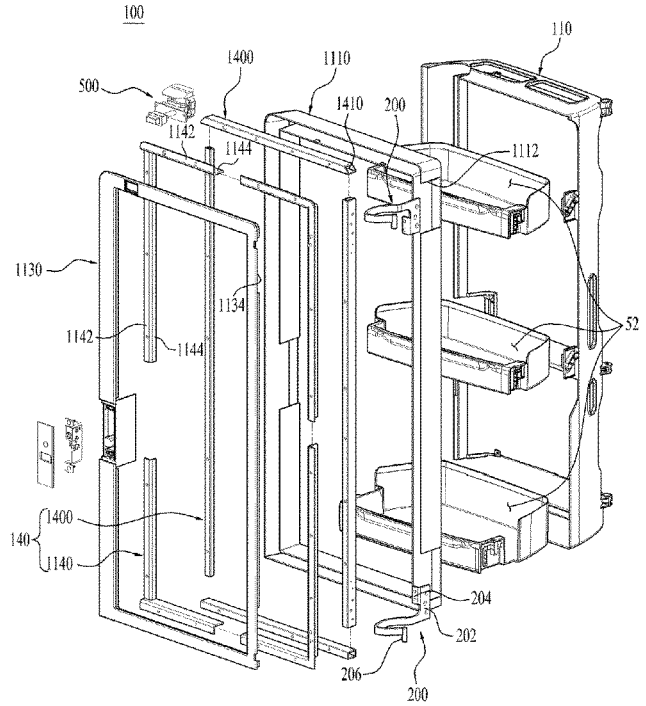

[Fig. 21]
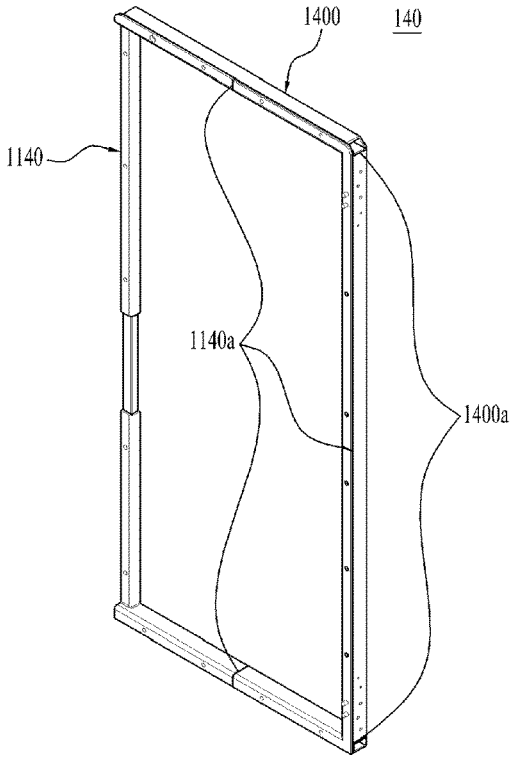
[Fig. 22]
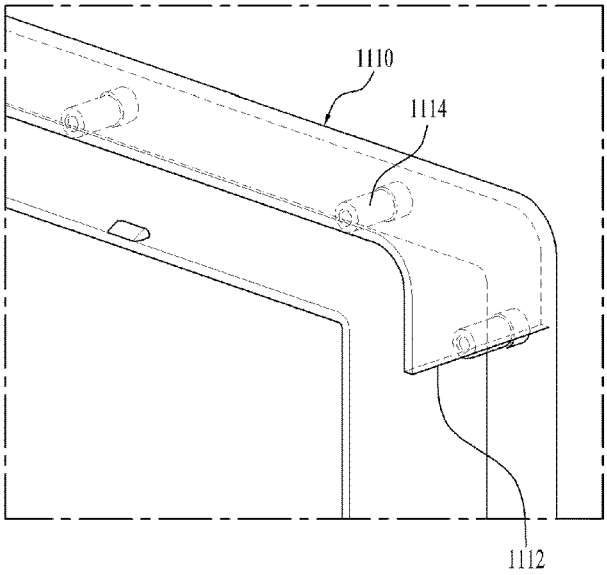

[Fig. 23]
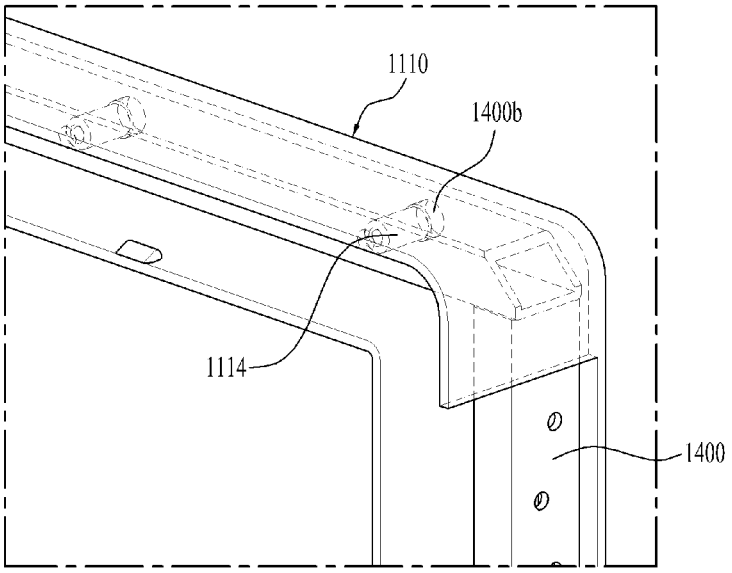
[Fig. 24]
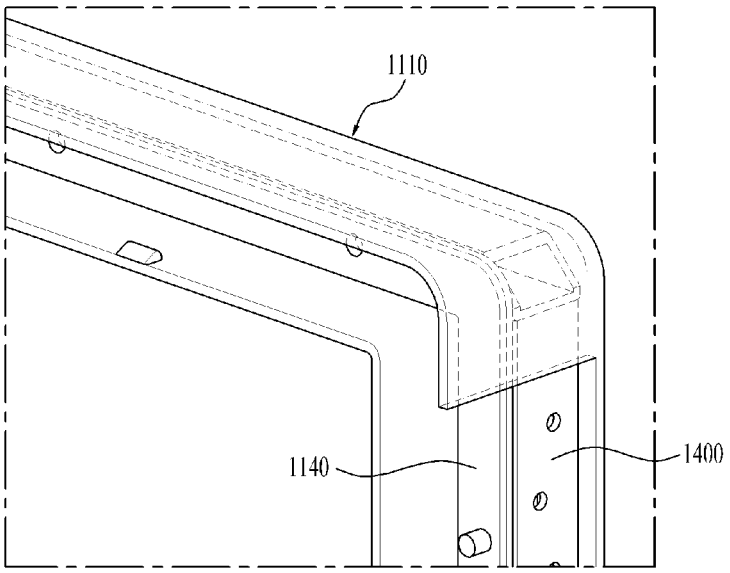

[Fig. 25]
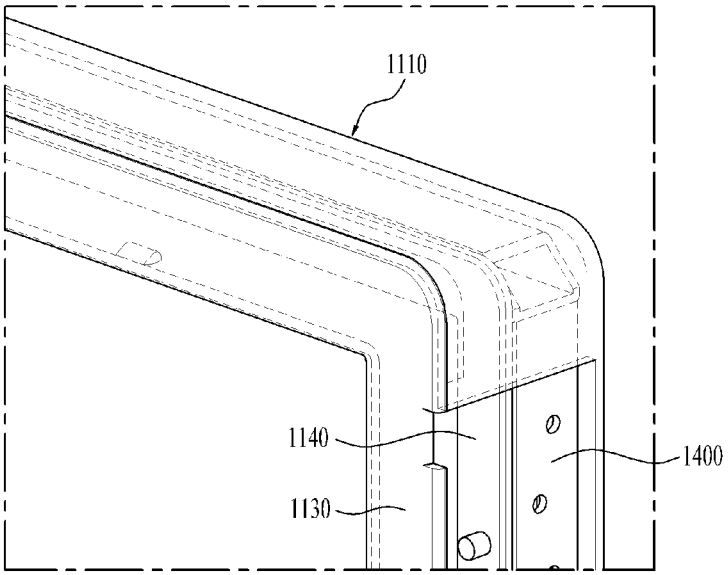
[Fig. 26]
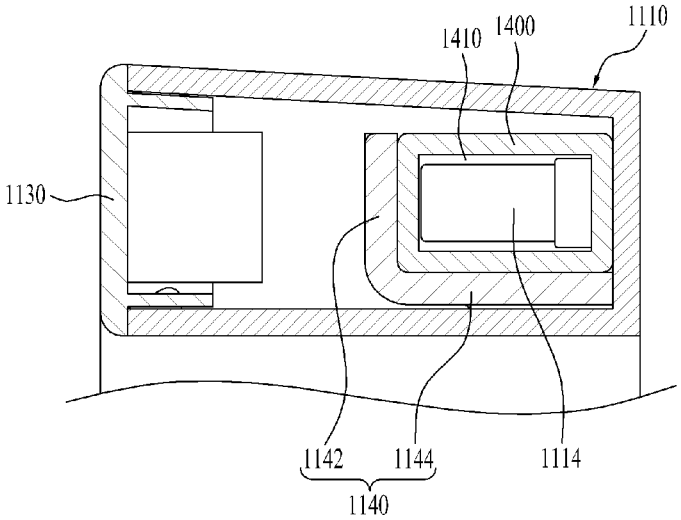

[Fig. 27]
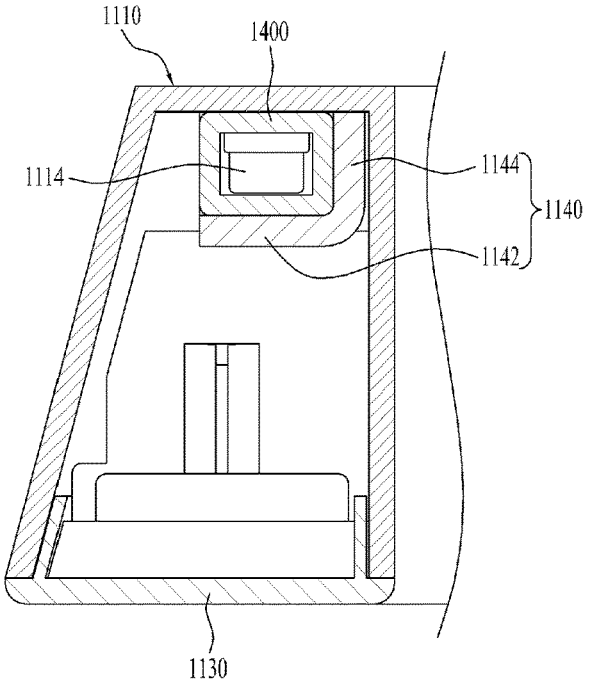
[Fig. 28]
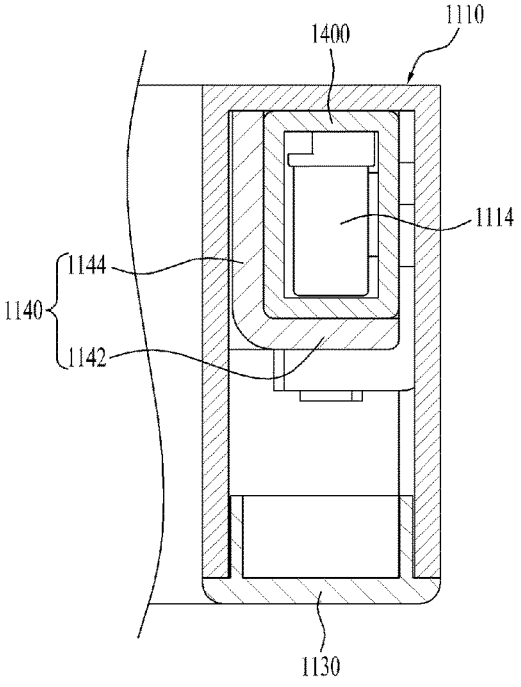

[Fig. 29]
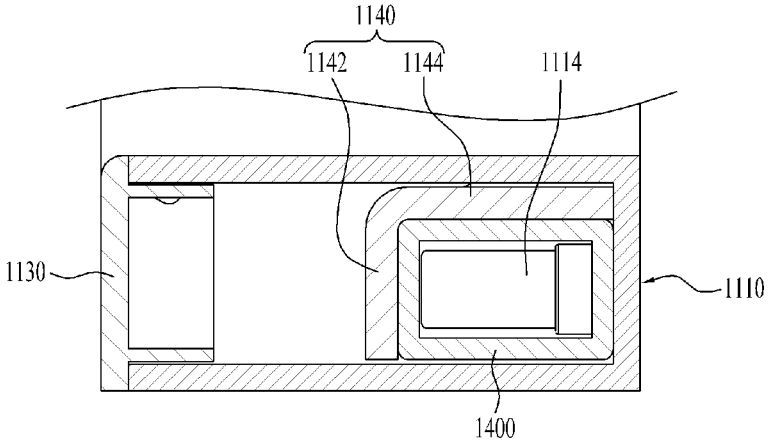
[Fig. 30]
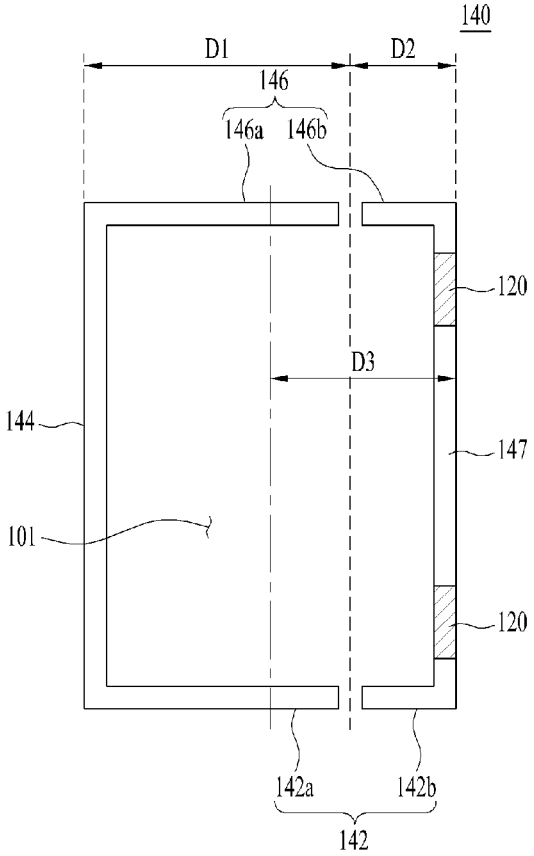

[Fig. 31]
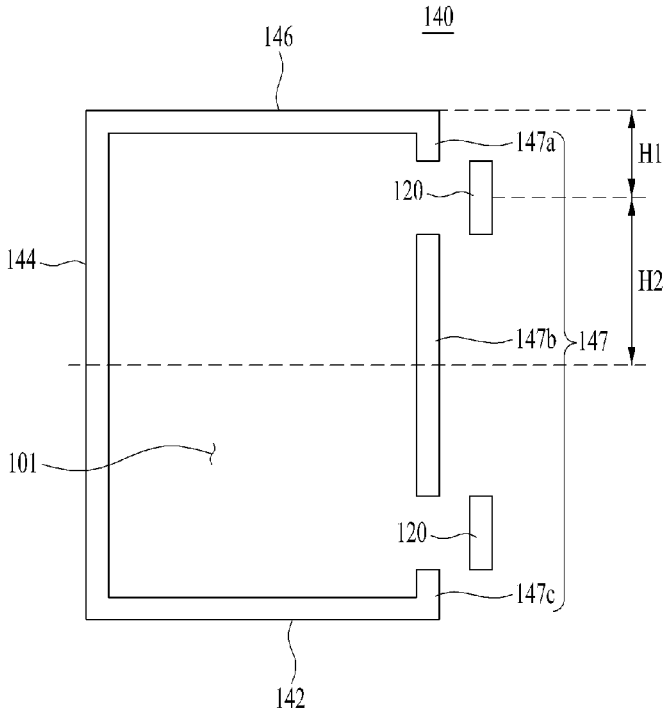

REFRIGERATOR

CROSS REFERENCE TO RELATED APPLICATIONS

This application is a continuation of U.S. application Ser. No. 14/898,469, filed on Dec. 14, 2015, now allowed, which is a U.S. National Phase Application under 35 U.S.C. § 371 of International Application PCT/KR2014/005250 filed on Jun. 16, 2014, which claims the benefit of Korean Application No. 10-2013-0068250, filed on Jun. 14, 2013, and Korean Application No. 10-2013-0124734, filed on Oct. 18, 2013, the entire contents of which are hereby incorporated by reference in their entireties.

TECHNICAL FIELD

The present invention relates to a refrigerator and, more particularly, to a refrigerator which includes an extra storage compartment in addition to a main storage compartment, thereby enhancing user convenience.

BACKGROUND ART

In general, a refrigerator is an apparatus that stores food and the like refrigerated or frozen by keeping a storage compartment defined in the refrigerator at a predetermined temperature using a refrigeration cycle consisting of a compressor, a condenser, an expansion valve and an evaporator. Such a refrigerator generally includes a freezing compartment in which food or beverages are kept frozen and a refrigerating compartment in which food or beverages are kept at a low temperature.

Refrigerators may be classified based on positions of the freezing compartment and the refrigerating compartment. For example, refrigerators may be classified into a top mount type refrigerator in which the freezing compartment is located above the refrigerating compartment, a bottom freezer type refrigerator in which the freezing compartment is located below the refrigerating compartment and a side by side type refrigerator in which the freezing compartment and the refrigerating compartment are left and right compartments divided by a partition.

The freezing compartment and the refrigerating compartment are defined in a cabinet that forms an external appearance of the refrigerator and are selectively opened or closed by a freezing compartment door and a refrigerating compartment door respectively. The freezing compartment door and the refrigerating compartment door are pivotally rotatably coupled to the freezing compartment and the refrigerating compartment which have open front sides. Each door is provided with a gasket for hermetic sealing of the interior of the storage compartment.

In recent years, refrigerators to satisfy various consumer demands and to prevent loss of cold air caused by frequent door opening/closing have been proposed. For example, as disclosed in Korean Patent Laid-open Publication No. 10-2010-0130508 filed and published by the applicant of the present invention, a refrigerator, which includes an extra storage space (hereinafter referred to as "auxiliary storage compartment" for convenience) in addition to a main storage compartment and allows a user to access the auxiliary storage compartment without opening a door of the refrigerator, has been proposed.

In the refrigerator as described above, it is necessary to install gaskets between the cabinet and the auxiliary storage compartment and between the refrigerating compartment door and the auxiliary storage compartment, in order to prevent leakage of cold air. For this reason, there is a need for installation of hot wires to prevent dew formation due to a temperature difference around the gaskets, which is disadvantageous in terms of refrigerator power consumption.

To solve the above-described problem, as disclosed in Korean Patent Laid-open Publication No. 10-2011-0040567 that is another patent application of the applicant of the present invention, a refrigerator in which a container having an auxiliary storage compartment is received at a given position within a main storage compartment of the refrigerator, i.e. a cabinet and only a single door is used has been proposed. However, providing the auxiliary storage compartment received within the cabinet has several problems that must be basically solved.

For example, in the case of the auxiliary storage compartment received within the main storage compartment of the refrigerator, i.e. the cabinet in a closed state of the refrigerator door, a body thereof is conventionally configured so as to be filled with an insulator, thus having a relatively large volume. The large volume of the body problematically causes corresponding reduction in the volume of an auxiliary storage region, i.e. a space for storage of food.

In addition, in the case in which the main storage compartment of the refrigerator is opened or closed by the single door, when attempting to open the large volume of the body received within the cabinet along with the refrigerator door or independently of the refrigerator door, interference between the body of the auxiliary storage compartment and an inner surface of the cabinet facing the body may occur, which may cause problematic separation and opening of the body from the cabinet.

Meanwhile, to evade the above-described problem, in the case in which the body of the auxiliary storage compartment must have a reduced volume, great load may be applied to the auxiliary storage compartment when food is placed in the auxiliary storage compartment. There is a requirement for technologies to prevent sagging of the auxiliary storage compartment despite the load of the auxiliary storage compartment.

DISCLOSURE OF INVENTION

Technical Problem

The present invention is directed to solving the above-described problems and one object of the present invention is to provide a refrigerator which may enhance user convenience and restrict increase in power consumption and which has a simplified configuration. In particular, the object of the present invention is to provide a refrigerator in which a refrigerator door may perform a role of sealing cold air of a refrigerator cabinet alone in a state in which a container having an auxiliary storage region is received at a given position within a main storage space of the refrigerator cabinet.

Another object of the present invention is to provide a refrigerator which may prevent deformation or sagging of a container having an auxiliary storage region.

Another object of the present invention is to provide a refrigerator which may provide an auxiliary storage region having a sufficient food storage space even in a state in which a container having the auxiliary storage region is received in a refrigerator cabinet.

A further object of the present invention is to provide a refrigerator in which a container having an auxiliary storage region may be smoothly opened without interference with an inner wall of a refrigerator cabinet when being opened along with a refrigerator door or independently of the refrigerator door in a state in which the container is received at a given position in the cabinet, i.e. a main storage compartment of the refrigerator.

Solution to Problem

To achieve the above-described objects of the present invention, in accordance with one embodiment of the present invention, a refrigerator includes a cabinet having at least one storage compartment in which food is stored, a first hinge member supported by the cabinet, at least one door connected to the first hinge member to open or close the storage compartment, the door being rotatable relative to the cabinet, the door having a gasket attached to an inner surface thereof, the gasket defining a sealing boundary to prevent leakage of cold air from the storage compartment, a container configured to define an auxiliary storage region separated from the storage compartment, the container being received in the storage compartment of the cabinet when the door is closed, the container being pivotally rotatable along with the door or independently of the door at a position separated from the cabinet, and a second hinge member configured to support the container in a pivotally rotatable manner, wherein the container is located inside the sealing boundary when the door is closed, and the gasket of the door comes into contact with a front surface of the cabinet to simultaneously seal the storage compartment of the cabinet and the auxiliary storage region of the container, wherein the container includes a body configured to support the auxiliary storage region, and wherein the body includes a plurality of horizontal and vertical members, and at least one integrated horizontal and vertical part configured to integrally connect the horizontal member and the vertical member to each other is formed at a corner of the body.

In the case in which the body includes a compact metal member, it should be considered that a center of gravity must be close to a pivoting member in order to minimize sagging due to the weight of the body including the above-described metal member. In addition, it is important to prevent the body from being distorted and deformed as the weight of the body is increased due to the weight of food stored in the auxiliary storage region. In particular, when it is desired to construct the body by assembling a plurality of metal members with one another in order to achieve a sufficient storage space by minimizing a volume of the body, the body must include an integrated horizontal and vertical part formed by integrally connecting the horizontal member and the vertical member to each other to prevent distortion caused when the weight of the body is concentrated at assembly positions and different magnitudes of weights are applied on a per position basis.

According to the embodiment of the present invention, the integrated horizontal and vertical part may be formed by bending a hollow metal rod, a solid metal member or a metal plate having two planes.

According to another embodiment of the integrated horizontal and vertical part, the integrated horizontal and vertical part located close to an installation position of the second hinge member may have a greater weight than a weight of the integrated horizontal and vertical part opposite to the installation position of the second hinge member.

In accordance with another embodiment of the present invention to achieve the above-described objects of the present invention, a refrigerator includes a cabinet having at least one storage compartment in which food is stored, a first hinge member supported by the cabinet, at least one door connected to the first hinge member to open or close the storage compartment, the door being rotatable relative to the cabinet, the door having a gasket attached to an inner surface thereof, the gasket defining a sealing boundary to prevent leakage of cold air from the storage compartment, a container configured to define an auxiliary storage region separated from the storage compartment, the container being received in the storage compartment of the cabinet when the door is closed, the container being pivotally rotatable along with the door or independently of the door at a position separated from the cabinet, and a second hinge member configured to support the container in a pivotally rotatable manner, wherein the container is located inside the sealing boundary when the door is closed, and the gasket of the door comes into contact with a front surface of the cabinet to simultaneously seal the storage compartment of the cabinet and the auxiliary storage region of the container, wherein the container includes a body configured to support the auxiliary storage region, wherein the body at least includes a first vertical frame configured to support the auxiliary storage region, the second hinge member being coupled to the first vertical frame, and a second vertical frame facing the first vertical frame, the second vertical frame being configured to support the auxiliary storage region, wherein, in a state in which the container is received in the storage compartment of the cabinet, the second vertical frame includes a front portion facing the door, the front portion being located in approximately the same plane as the front surface of the cabinet, a rear portion facing the storage compartment, the rear portion being located in the storage compartment of the cabinet, a first side portion corresponding to the auxiliary storage region (opening) of the container, and a second side portion corresponding to the interior of the container (opposite to the opening), and wherein the rear portion has a less horizontal width than a horizontal width of the front portion.

In accordance with the embodiment of the present invention, the second side portion may have a front edge and a rear edge, the front edge protruding closer to the container than the rear edge. This serves to prevent a portion of the container from interfering a rotation path of the rear edge of the second side portion when the container is rotated relative to a rotating shaft of the second hinge member.

In accordance with the embodiment of the present invention, the front edge of the second side portion may be provided with a gasket extending in an up-and-down direction.

In accordance with another embodiment of the present invention to achieve the above-described objects of the present invention, a refrigerator includes a cabinet having at least one storage compartment in which food is stored, a first hinge member supported by the cabinet, at least one door connected to the first hinge member to open or close the storage compartment, the door being rotatable relative to the cabinet, the door having a gasket attached to an inner surface thereof, the gasket defining a sealing boundary to prevent leakage of cold air from the storage compartment, a container configured to define an auxiliary storage region separated from the storage compartment, the container being received in the storage compartment of the cabinet when the door is closed, the container being pivotally rotatable along with the door or independently of the door at a position separated from the cabinet, and a second hinge member configured to support the container in a pivotally rotatable manner, wherein the container is located inside the sealing boundary when the door is closed, and the gasket of the door comes into contact with a front surface of the cabinet to simultaneously seal the storage compartment of the cabinet and the auxiliary storage region of the container, wherein the container includes a body configured to support the auxiliary storage region, wherein the body includes a first vertical portion coupled to the second hinge member, a second vertical portion arranged to face the first vertical portion, the second vertical portion supporting the auxiliary storage region, a first horizontal portion interconnecting upper ends of the first vertical portion and the second vertical portion and a second horizontal portion interconnecting lower ends of the first vertical portion and the second vertical portion, the first horizontal portion or the second horizontal portion is formed of two members, wherein the first horizontal portion or the second horizontal portion includes two members and a connection portion for connection of the two members, and wherein a horizontal distance from the first vertical portion to the connection portion is equal to or less than a horizontal distance from the first vertical portion to the center of the first horizontal portions or the second horizontal portions.

In accordance with the embodiment of the present invention, the first vertical portion may include at least one connecting portion, and a vertical distance from the first or second horizontal portion to the connecting portion may be equal to or less than a vertical distance from the center of the first vertical portion to the connecting portion.

In accordance with the embodiment of the present invention, at least a portion of the first horizontal portion and at least a portion of the second horizontal portion may be integrally formed with the second vertical portion.

In accordance with the embodiment of the present invention, at least a portion of the first horizontal portion, at least a portion of the second horizontal portion and the second vertical portion may be formed of a hollow metal member respectively.

In accordance with the embodiment of the present invention, at least a portion of the first horizontal portion or the second horizontal portion may be integrally formed with at least a portion of the first vertical portion. The second hinge member may be attached to a portion formed by integrally connecting the first vertical portion and the first horizontal portion or the second horizontal portion to each other.

In accordance with the embodiment of the present invention, the second hinge member attached to the first vertical portion may be positioned such that a vertical distance from the center of the first vertical portion to the second hinge member is greater than a vertical distance from the first horizontal portion or the second horizontal portion to the second hinge member.

In accordance with the embodiment of the present invention, at least a portion of the first horizontal portion or the second horizontal portion is integrally formed with at least a portion of the first vertical portion and the integrally formed portion may take the form of a solid metal member acquired by casting.

In accordance with another embodiment of the present invention, there is provided a refrigerator including a cabinet configured to define a first storage region in which food is stored, a door rotatably connected to a first rotating shaft via a first hinge member to open or close the first storage region, the first rotating shaft being located at the front of the cabinet, a gasket provided at the door, and a container configured to define a second storage region, the second storage region being received in the first storage region, the container being rotatably connected to a second rotating shaft via a second hinge member, the second rotating shaft being located at the door, wherein the container includes a centrally formed opening and a body configured to define a periphery of the opening in a rectangular form, wherein the body includes a frame and a frame cover configured to surround the frame, wherein the frame includes a first member defining a lower side, a second member placed at one end of the first member to extend perpendicular to the first member, a third member placed at one end of the second member to extend perpendicular to the second member and a fourth member placed perpendicular to the first member, wherein the second hinge member is installed to the fourth member, and wherein the first member, the second member and the third member are integrally formed with one another.

The frame may generally have a rectangular form such that the first member, the second member, the third member and the fourth member define respective sides of a rectangle. As such, a space in which food may be stored may be defined by the opening formed in a central region of the frame.

The frame may further include a bent portion in the form of an angled connecting portion between the first member and the second member or between the second member and the third member, and the bent portion may be formed of the same material as a constituent material of the first member, the second member and the third member.

In accordance with another embodiment of the present invention, there is provided a refrigerator including a cabinet configured to define a first storage region in which food is stored, a door rotatably connected to a first rotating shaft via a first hinge member to open or close the first storage region, the first rotating shaft being located at the front of the cabinet, a gasket provided at the door, and a container configured to define a second storage region, the second storage region being received in the first storage region, the container being rotatably connected to a second rotating shaft via a second hinge member, the second rotating shaft being located at the door, wherein the container includes a centrally formed opening and a body configured to define a periphery of the opening in a rectangular form, wherein the body includes a frame and a frame cover configured to surround the frame, and wherein the frame includes a plurality of bent portions formed by bending a single pipe.

Since the bent portion is formed by bending a single pipe, the bent portion may have no effect on increase in the width of the container. Accordingly, it is possible to reduce sagging of the container under condition of the same weight.

In addition, bending of the single pipe may reduce efforts required to couple a plurality of components to one another, which may ensure easier manufacture.

In particular, the frame may include a hinge coupler coupled to the second hinge member and the second hinge member may be coupled to the frame. The frame cover may be formed of a material that enables easier molding than the frame, such as a plastic material or the like and, therefore, the frame cover may have less strength than that of the frame. In the present invention, as the second hinge member is directly coupled to the frame via the hinge coupler, stable force transfer to the second hinge member is possible.

In accordance with another embodiment of the present invention, there is provided a refrigerator including a cabinet configured to define a first storage region in which food is stored, a door rotatably connected to a first rotating shaft via a first hinge member to open or close the first storage region, the first rotating shaft being located at the front of the cabinet, a gasket provided at the door, and a container configured to define a second storage region, the second storage region being received in the first storage region, the container being rotatably connected to a second rotating shaft via a second hinge member, the second rotating shaft being located at the door, wherein the container includes a centrally formed opening and a body configured to define a periphery of the opening in a rectangular form, wherein the body includes a frame and a frame cover configured to surround the frame, wherein the frame includes a hinge coupler configured to couple the second hinge member to the frame, and wherein the hinge coupler has a coupling slit through which the second hinge member is inserted and coupled.

The hinge coupler and the second hinge member may come into surface contact with and be coupled to each other as the second hinge member is inserted into and coupled to the hinge coupler. Accordingly, when the weight of the container is transferred to the second hinge member, the weight of the container is not concentrated at a specific point and may be distributed to the second hinge member over a wide area.

The hinge coupler may be manufactured by aluminum die casting differently from other members of the frame, thus achieving greater strength than that of the other members. This is because it is preferable to achieve sufficient strength of the hinge coupler because the weight of the container is transferred to the second hinge member via the hinge coupler.

In accordance with another embodiment of the present invention, there is provided a refrigerator including a cabinet configured to define a first storage region in which food is stored, a door rotatably connected to a first rotating shaft via a first hinge member to open or close the first storage region, the first rotating shaft being located at the front side of the cabinet, a gasket provided at the door, and a container configured to define a second storage region, the second storage region being received in the first storage region, the container being rotatably connected to a second rotating shaft via a second hinge member, the second rotating shaft being located at the door, wherein the container includes a body configured to support the second storage region, wherein the body includes a first vertical member coupled to the second hinge member and a second vertical member facing the first vertical portion, the second vertical member being configured to support the second storage region, and wherein the first vertical member has a greater weight than a weight of the second vertical member such that a center of gravity of the body is deviated to the first vertical member coupled to the second hinge member.

In accordance with the embodiment of the present invention, the portion of the frame close to the second hinge member may have a greater cross sectional area than a cross sectional area of the portion of the frame far from the second hinge member.

In accordance with the embodiment of the present invention, the second vertical member constituting a portion of the body may be a hollow rod-shaped metal member or a bent planar metal member, and at least a portion of the first vertical member constituting a portion of the body may be a solid metal member formed by aluminum die casting. In this case, the second hinge member installed to the first vertical member may be located at the solid metal member.

In accordance with the embodiment of the present invention, the portion of the body of the container close to the second hinge member may have a greater weight than a weight of the portion of the frame far from the second hinge member. This is because moment applied to the second hinge member is reduced at the portion of the frame close to the second hinge member and the portion of the frame close to the second hinge member is less vulnerable to sagging of the container due to the moment.

In accordance with the embodiment of the present invention, the body may include a frame, and the frame may include a first member defining a lower side, a second member placed at one end of the first member to extend perpendicular to the first member, a third member placed at one end of the second member to extend perpendicular to the second member and a fourth member placed perpendicular to the first member, and the second member may have a less cross section than a cross section of the fourth member. Assuming that the first member, the second member, the third member and the fourth member are formed of the same material, the less cross section of the second member may be confirmed by overlapping the second member and the fourth member each other to compare sizes thereof. Such a reduced cross section may result in reduced weight.

In accordance with another embodiment of the present invention, there is provided a refrigerator including a cabinet configured to define a first storage region in which food is stored, a door rotatably connected to a first rotating shaft via a first hinge member to open or close the first storage region, the first rotating shaft being located at the front side of the cabinet, a gasket provided at the door, and a container configured to define a second storage region, the second storage region being received in the first storage region, the container being rotatably connected to a second rotating shaft via a second hinge member, the second rotating shaft being located at the door, wherein the container includes a centrally formed opening and a body configured to define a periphery of the opening in a rectangular form, wherein the body includes a frame, and wherein the frame has a rectangular shape in the same manner as the body and the frame includes an integrally formed portion extending along two edges from at least one angular point among four angular points of the frame.

The frame is bent by an approximately 90 degrees at portions thereof corresponding to angular points of a rectangle. Therefore, force may be concentrated at these bent portions of the frame rather than edges of the frame, which may increase sagging of the container. To solve this problem, in the present invention, the frame may be provided with an integrally formed member having no coupling seam at a portion thereof corresponding to at least one angular point of a rectangle.

In particular, the integrally formed member extending along the two edges may be located at the angular point far from the second hinge member among the four angular points of the frame. This is because greater moment may be generated under condition of the same magnitude of force with increasing distance from the second hinge member.

In accordance with a further embodiment of the present invention, there is provided a refrigerator including a cabinet configured to define a first storage region in which food is stored, a door rotatably connected to a first rotating shaft via a first hinge member to open or close the first storage region, the first rotating shaft being located at the front side of the cabinet, a gasket provided at the door, and a container configured to define a second storage region, the second storage region being received in the first storage region, the container being rotatably connected to a second rotating shaft via a second hinge member, the second rotating shaft being located at the door, wherein the container includes a centrally formed opening, a body configured to define a periphery of the opening in a rectangular form and a hinge coupler coupled to the second hinge member, and wherein the hinge coupler is located closer to the top or the bottom of the container than a center of the container.

The hinge coupler is coupled to the second hinge member to transfer the weight of the container to the door and, thus, force may be concentrated at the hinge coupler. Meanwhile, when two hinge couplers are used, the hinge couplers may be spaced apart from each other by a long distance rather than being arranged close to each other. This is because arranging the two hinge couplers, at which force is concentrated, close to each other, may disadvantageously cause force to be concentrated at a corresponding portion of the frame.

In particular, in the present invention, the container may include a first member defining a lower side, a second member placed at one end of the first member to extend perpendicular to the first member, a third member placed at one end of the second member to extend perpendicular to the second member and a fourth member placed perpendicular to the first member, and the hinge coupler may be arranged to connect the first member and the fourth member to each other. That is, the two hinge couplers may be arranged respectively at two upper and lower angular points among four angular points such that the weight of the container transferred to the hinge couplers is distributed to a wide area of the frame.

Advantageous Effects of Invention

Effects of a refrigerator according to the present invention as described above are as follows.

Firstly, according to the present invention, a single door is provided to open or close a main storage region and an auxiliary storage region. As such, it is possible to reduce loss of cold air as compared to the case in which two doors are provided and it is un-necessary to install a heater to prevent dew formation. Accordingly, increase in power consumption may be advantageously prevented.

Secondly, according to the present invention, it is possible to reduce deformation of a container having an auxiliary storage region. Moreover, through stable coupling of the container and a second hinge member, it is possible to reduce sagging of the container.

Thirdly, according to the present invention, it is possible to reduce the weight of the container.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view showing an embodiment of a refrigerator according to the present invention;

FIG. 2 is a perspective view showing a state in which a door of the refrigerator shown in FIG. 1 is opened alone;

FIG. 3 is a perspective view showing a state in which a container and the door of the refrigerator shown in FIG. 1 are opened;

FIG. 4 is a perspective view schematically showing the container shown in FIG. 1;

FIG. 5 is a view showing important parts of the container according to one embodiment of the present invention;

FIG. 6 is an exploded perspective view of FIG. 5;

FIG. 7 is a view showing a coupling relationship of a frame;

FIG. 8 is a view schematically explaining a device to manufacture a frame and a shape of the manufactured frame;

FIG. 9 is a perspective view showing the back of the container;

FIG. 10 is an exploded perspective view of a coupling device for a cover;

FIG. 11 is a view explaining operation of the coupling device;

FIG. 12 is a sectional view showing a state in which the container closes a first storage region;

FIG. 13 is a top plan view of FIG. 12;

FIGS. 14 and 15 are views showing an embodiment different from FIGS. 12 and 13;

FIG. 16 is a sectional view showing a state in which the door and the container hermetically seal a cabinet;

FIG. 17 is a perspective view of the container;

FIG. 18 is a view showing a basket of FIG. 17;

FIG. 19 is a view showing a container according to another embodiment of the present invention, from which a container housing has been removed;

FIG. 20 is an exploded perspective view of the container according to another embodiment;

FIG. 21 is a view showing a frame included in a body;

FIGS. 22 to 25 are views showing a coupling procedure of portion 'E' of the container shown in FIG. 19;

FIG. 26 is a sectional view taken along line A-A of FIG. 19;

FIG. 27 is a sectional view taken along line B-B of FIG. 19;

FIG. 28 is a sectional view taken along line C-C of FIG. 19;

FIG. 29 is a sectional view taken along line D-D of FIG. 19; and

FIGS. 30 and 31 are views explaining the concept of the frame according to the present invention.

BEST MODE FOR CARRYING OUT THE INVENTION

Hereinafter, preferred embodiments of the present invention to concretely achieve the above-described objects will be described with reference to the accompanying drawings.

The size, shape or the like of components shown in the drawings may be exaggerated for clarity and convenience of description. In addition, the terms, particularly defined by taking into consideration the configurations and functions of the present invention, may be replaced by other terms based on intensions of users or operators or customs. Hence, the meanings of these terms must follow definitions described in the entire specification.

In FIG. 1, a storage compartment in which food and the like may be stored, for example, a refrigerating compartment is defined in a cabinet 10 and a freezing compartment is also defined below the refrigerating compartment. To open or close the refrigerating compartment, a door 20 is rotatably installed to an upper portion of the cabinet 10 via a hinge member 40 (hereinafter referred to as "first hinge member" for convenience). Although the present embodiment illustrates two doors 20 to open or close the refrigerating compartment, it will be appreciated that the present embodiment is not limited thereto and a single door may be used. The door 20 is provided with a handle 22 to assist a user in pivotally rotating the door 20. Of course, the shape or structure of the handle 22 is not limited to illustration of the drawing and various other structures may be selected.

A dispenser 30 may be installed in the door 20 to provide the user with water or ice. An additional door 20*a* may be installed to a lower portion of the cabinet 10 to open or close the freezing compartment.

Meanwhile, as exemplarily shown in FIG. 2, a storage space in which food may be stored, i.e. the refrigerating compartment 2 is defined in the cabinet 10. Although the present embodiment mainly describes the refrigerating compartment for convenience of description, the present embodiment is not limited to the refrigerating compartment and may be applied to any other storage space, such as, for example, the freezing compartment so long as it may store food and the like therein. Therefore, for convenience, the storage space is referred to as "first storage region".

In the present embodiment, there is provided a container 100 that defines a storage compartment 52 (hereinafter referred to as "second storage region" for convenience) separate from the first storage region 2. The container 100 is rotatable relative to the door 20. That is, the container 100 is a separate component that is operated independently of the cabinet 10 and the door 20.

Hereinafter, a relationship of the cabinet 10, the door 20 and the container 100 and configurations of the same will be described in detail with reference to FIG. 2. FIG. 2 shows a state in which the container 100 is received in the cabinet 10 and the door 20 is opened alone.

The door 20 is pivotally rotatably coupled to the cabinet 10 via the first hinge member 40. The first hinge member 40 is located at one side of the cabinet 10. The door 20 is pivotally rotatable about a rotating shaft 42 (hereinafter referred to as "first rotating shaft" for convenience) of the first hinge member 40 and may open or close the first storage region 2.

A gasket 26 is attached to an inner surface of the door 20. The gasket 26 is located along a rim of the door 20. The gasket 26 may generally take the form of a rectangular band conforming to a rectangular shape of the door 20. Once the door 20 is rotated toward the cabinet 10 to hermetically seal the first storage region 2, the gasket 26 comes into contact with a front surface portion 12 of the cabinet 10, thus functioning to prevent leakage of cold air from the first storage region 2.

Meanwhile, the container 100 is pivotally rotatably coupled to the door 20 via a second hinge member 200. A rotating shaft (hereinafter referred to as "second rotating shaft" for convenience) of the second hinge member 200 is located at the door 20 and is separate from the first rotating shaft 42 of the first hinge member 40. That is, the first hinge member 40 is interposed between the cabinet 10 and the door 20 and the second hinge member 200 is interposed between the door 20 and the container 100.

Hereinafter, for convenience of description, the terms "up-and-down direction", "left-and-right direction" and "front-and-rear direction" as described in FIG. 2 are used. Preferably, dimensions of the container 100 (a left-and-right direction length (width) and an up-and-down direction length (height)) must substantially be at least not greater than those of the first storage region 2 such that the container 100 is received in the first storage region 2. A depth (front-and-rear direction length) of the container 100 preferably occupies a predetermined part of a depth of the first storage region 2. Through this configuration, when the door 20 is closed, the container 100 is placed in the first storage region 2 and, therefore, leakage of cold air may occur only through a gap between the front surface portion 12 of the cabinet 10 and an inner rim portion of the door 20. Thus, it is possible to prevent leakage of cold air by simply attaching the single gasket 26 to the inner rim portion of the door 20. Accordingly, in the present embodiment, the gasket 26 for the door 20 may be sufficient without requiring a gasket for the container 100. In this way, according to the present invention, it is possible to effectively prevent loss of cold air due to installation of a number of gaskets, waste of power required for heating and the like.

Meanwhile, a fastening device 600 to selectively couple the container 100 and the door 20 to each other is preferably installed to the door 20. More specifically, the fastening device 600 functions to couple the door 20 and the container 100 to each other when it is desired to open the door 20 and the container 100 together and also functions to release coupling of the door 20 and the container 100 when it is desired to open the door 20 alone. To implement coupling and release of the door 20 and the container 100 via the fastening device 600, the handle 22 is preferably provided with an operating unit.

Meanwhile, a storage member 24 for storage of food therein may be installed to the inner surface of the door 20. More specifically, after the door 20 is opened by the user as exemplarily shown in FIG. 2, the user may access the storage member 24 to store food in the storage member 24 installed to the inner surface of the door 20 or to retrieve the stored food. Of course, instead of providing the door 20 with the storage member 24, the container 100 may be increased in depth such that the container 100 uses a space occupied by the storage member 24 of the door 20.

Next, a case in which the door 20 and the container 100 are opened together will be described with reference to FIG. 3.

When the user who desires to use the first storage region 2 opens the door 20 and the container 100 together, the user can access the first storage region 2. The first storage region 2 may have substantially the same configuration as that of a storage compartment of a general refrigerator. For example, the first storage region 2 may contain a plurality of shelves 4 and drawers 6 and the like.

Meanwhile, the container 100 is preferably provided with a fixing device 500 to selectively couple the container 100 to the cabinet 10. More specifically, the fixing device 500 functions to couple the container 100 and the cabinet 10 to each other when it is desired to open the door 20 alone and also functions to release coupling of the container 100 and the cabinet 10 when it is desired to open the door 20 and the container 100 together.

A left one of the two doors 20 is provided at one side thereof with a filler 62. The filler 62 is located between the two doors 20 when the two doors 20 are positioned to hermetically seal the first storage region 2, thereby preventing leakage of cold air through a gap between the two doors 20. It is clear that the filler 62 is conventionally used technology and, thus, a detailed description thereof will be omitted herein.

Referring to FIG. 4, the container 100 centrally has an opening 101. A basket 181 for storage of food therein may be located in the opening 101.

Meanwhile, a frame cover 103 may be installed around the container 100. The frame cover 103 may surround a frame (140: see FIG. 5) located inside thereof to prevent the frame from being exposed outward. The frame cover 103 may be formed of a plastic material that can be easily processed into various shapes. In consideration of the fact that the frame cover 103 is exposed to the user, the frame cover 103 may have an aesthetically pleasing shape.

The container 100 may include a container housing 110 at the back of the container 100. In this case, the container housing 110 of the container 100 may be oriented to face the first storage region 2.

Explaining the container 100 with reference to FIGS. 5 to 7, the container 100 may include the opening 101 and a body 116 configured to define a periphery of the opening 101 in a rectangular form.

The body 116 may include the frame 140 forming an external appearance of the body 116.

In this case, the body 116 may form a framework of the container 100.

The frame 140 may be surrounded by the above-described frame cover 103 so as not to be exposed outward. Preferably, the frame 140 is formed of a material different from that of the frame cover 103, i.e. a material having a greater strength. More preferably, the frame 140 is formed of a metal and is manufactured by bending.

The body 116 generally has a rectangular shape and the opening 101 is formed in the center of the body 116.

In this case, the body 116 may take the form of a rectangular band and the opening 101 may be formed in the center of the body 116 to provide a space in which food may be stored. As such, the body 116 of the container 110 may achieve an increased space for storage of food beyond that in a general door. Differently from a door that is conventionally shaped to define a single plane to hermetically seal a specific region, the body 116 of the container 100 is centrally provided with an empty space corresponding to the opening 101. Therefore, it is necessary to increase strength of the body 116 in order to prevent, for example, sagging of the container 100. Technologies with regard to increase in the strength of the body 116 will be described later in detail.

The frame 140 may have a shape similar to that of the body 116 to form an external appearance of the body 116.

Meanwhile, angular points, i.e. corners of the frame 140 may be curved by a predetermined curvature. It is not essential to form the angular points of the frame 140 at an accurate right angle. That is, the frame 140 may have a substantially rectangular shape.

The frame 140 may be comprised of a first member 142 forming a lower side, a second member 144 forming one lateral side, a third member 146 forming an upper side and a fourth member 147 forming the other lateral side. That is, the first member 142, the second member 144, the third member 146 and the fourth member 147 may form respective sides of a rectangle.

Preferably, the first member 142, the second member 144 and the third member 146 are integrally formed with one another. The first member 142, the second member 144 and the third member 146 construct a single continuous component and, therefore, load applied to any one location of the single continuous component may be successively transferred and distributed to the respective members. Accordingly, as compared to a configuration in which the respective members are separate components coupled to one another, the container 100 may exhibit less deformation.

In particular, the frame 140 includes a first bent portion 143 connecting the first member 142 and the second member 144 to each other at an angle. The first bent portion 143 is preferably formed of the same material as the first member 142 and the second member 144 to continuously connect the first member 142 and the second member 144 to each other. That is, the first bent portion 143 is not a separate component, but an integrally formed bent portion between the first member 142 and the second member 144.

In addition, the frame 140 includes a second bent portion 145 connecting the second member 144 and the third member 146 to each other at an angle. The second bent portion 145 is preferably formed of the same material as the second member 144 and the third member 146 to continuously connect the second member 144 and the third member 146 to each other. In the same manner as the first bent portion 143, the second bent portion 145 is not a separate component, but an integrally formed bent portion between the second member 144 and the third member 146.

In general, the first member 142, the second member 144 and the third member 146 may configure a "c"-shaped hollow pipe having two bent portions.

The first member 142, the second member 144 and the third member 146 may be hollow members. This may reduce the weight of the frame 140, i.e. the weight of the entire container 100. In this way, the magnitude of deformation caused by the weight of the container 100 may be reduced.

Meanwhile, the fourth member 147 may consist of hinge couplers 120 and a connecting portion 147*a* connecting the two hinge couplers 120 to each other. In this case, the hinge couplers 120 are components separate from the first member 142, the second member 144 and the third member 146 and may be coupled respectively to the first member 142 and the third member 146.

The connecting portion 147*a* may have a hollow shape in the same manner as the first member 142 and the like. As such, the hinge couplers 120 may be inserted into and coupled to the hollow connecting portion 147*a*.

Each hinge coupler 120 may serve to couple the second hinge member 200 to the frame 140. In particular, the hinge coupler 120 may have a solid shape differently from the first member 142, the second member 144, the third member 146 and the connecting portion 147*a*. The hinge coupler 120 may be manufactured by aluminum die casting, thus achieving sufficient strength.

In addition, the hinge coupler 120 may be manufactured by forging to achieve greater strength than that of the first member 142 and the like.

As the hinge coupler 120 is connected to the second hinge member 200, the hinge coupler 120 substantially functions to transfer the weight of the container 100 to the door 20 through the second hinge member 200. Accordingly, in consideration of the fact that force applied to the container 100 is concentrated at the hinge coupler 120, the hinge coupler 120 preferably has sufficient strength. Therefore, it is preferable to increase strength of the hinge coupler 120 beyond that of the first member 142, the second member 144 and the third member 146. To this end, the hinge coupler 120 may be formed of a material having greater strength than that of the first member 142, the second member 144 and the third member 146, or may be manufactured by various other methods to increase strength. In this way, the hinge coupler 120 may be pre-fabricated as a separate component and thereafter be assembled, differently from the first member 142, the second member 144 and the third member 146.

In particular, the container 100 is coupled to the door 20 via the second hinge member 200. Preferably, members far from the second hinge member 200, i.e. the first member 142, the second member 144 and the third member 146 have cavities 141, in order to reduce the weight of the frame 140. Torque is generally calculated using weight and a level arm from an application point of force. This is because the first member 142, the second member 144 and the third member 146 are located relatively far from the second hinge member 200 that is an application point of force and have a long level arm and, therefore, may have a great effect on sagging of the container 100.

In this case, the hinge coupler 120 may be inserted into the cavity 141 and be coupled to the first member 142 or the third member 146. In particular, the cavity 141 may have a rectangular cross section.

To allow torque of the second hinge member 200 to be stably transferred to the container 100 through the hinge coupler 120, the hinge coupler 120 is preferably not rotated relative to the first member 142, the third member 146 and the connecting portion 147*a*. For example, in a case in which the hinge coupler 120 is coupled to the first member 142, the third member 146 and the connecting portion 147*a* in a slipping manner, only relative rotation (idle rotation) between the hinge coupler 120, the first member 142, the third member 146 and the connecting portion 147*a* occurs even if torque of the second hinge member 200 is directly transferred to the hinge coupler 120.

Accordingly, in the present invention, to prevent rotation due to slippage, the cavity 141 and the hinge coupler 120 to be inserted into the cavity 141 may have an angled cross section, i.e. a polygonal cross section. A polygonal shape may effectively prevent slippage owing to a contained angle between respective neighboring faces of a polygon.

The hinge coupler 120 may have a coupling slit 130 into which the second hinge member 200 is inserted and coupled. That is, as a portion of the second hinge member 200 is inserted into the coupling slit 130, the second hinge member 200 and the hinge coupler 120 may be coupled to each other.

The coupling slit 130 may be formed in the center of the hinge coupler 120 such that planar portions are present at upper and lower sides and left and right sides of the coupling slit 130. As such, the second hinge member 200 may come into surface contact with and be coupled to the hinge coupler 120 within the coupling slit 130.

In this case, the coupling slit 130 may have a greater length than a width. Providing the coupling slit 130 with a less width than a length may reduce the area of a dead space in which food cannot be stored.

Meanwhile, owing to the long length, the coupling slit 130 may achieve sufficient strength against torque caused by vertical force once the second hinge member 200 has been coupled to the hinge coupler 120.

The hinge coupler 120 may have fastening holes 132 arranged perpendicular to the coupling slit 130. Fastening elements, for example, bolts may be fastened through the fastening holes 132 to increase coupling force of the second hinge member 200 and the hinge coupler 120, thereby enabling maintenance of stable coupling. The fastening holes 132 and the coupling slit 130 may provide coupling force of the hinge coupler 120 and the second hinge member 200 in different directions. In other words, the fastening holes 132 may be used for front-and-rear direction coupling of the second hinge member 200 and the hinge coupler 120, whereas the coupling slit 130 may be used for left-and-right direction coupling of the second hinge member 200 and the hinge coupler 120.

The second hinge member 200 may include an insert portion 210 to be inserted into the coupling slit 130 and a seat portion 220 having a greater cross sectional area than that of the insert portion 210.

The insert portion 210 may be inserted into the coupling slit 130 while coming into surface contact with the coupling slit 130.

In this case, the seat portion 220 may be stepped relative to the insert portion 210.

In particular, in terms of a cross section, the seat portion 220 may have a greater height than that of the insert portion 210 and a stepped portion between the seat portion 220 and the insert portion 210 may be caught by the edge of the coupling slit 130. As such, when vertical force is applied to the second hinge member 200, it is possible to prevent the second hinge member 200 from being vertically rotated relative to the hinge coupler 120.

In addition, by providing the seat portion 220 inserted into the coupling slit 130 with a sufficient height corresponding to that of the coupling slit 130, it is possible to increase strength against vertical force applied to the hinge coupler 120.

The hinge coupler 120 may be comprised of a first coupling portion 122 in the form of a horizontally extending portion and a second coupling portion 126 bent from the first coupling portion 122 at a right angle. The first coupling portion 122 and the second coupling portion 126 may be bent perpendicular to each other.

As the hinge coupler 120 is divided into the first coupling portion 122 and the second coupling portion 126 having a predetermined angle therebetween, the hinge coupler 120 may be coupled to the respective members at different angles. Torque of the second hinge member 200 increases as a radius of rotation, i.e. a length of the first coupling portion 122 increases and, thus, increased torque is transferred to the container 100. As a result, torque generated by rotation of the second hinge member 200 may be stably transferred to the container 100, thereby allowing the container 100 to be stably rotated in response to rotation of the second hinge member 200.

Meanwhile, the frame 140 is provided at four angular points thereof with the first bent portion 143, the second bent portion 145 and the two hinge couplers 120 respectively.

Explaining the above configuration with reference to FIG. 8, the frame 140 may initially take the form of an elongated hollow pipe having a polygonal cross section before implementation of a bending process.

As exemplarily shown in FIG. 8, the frame 140 may be finally bent at a right angle via primary bending and secondary bending. In this case, a bending angle of the frame 140 may be less in primary bending than that in secondary bending. After completion of secondary bending, the frame 140 is comprised of the first member 142, the second member 144, the third member 146, the first bent portion 143 and the second bent portion 145.

A device for bending of the frame 140 may include a number of punches that apply force in contact with the frame 140.

More particularly, the frame 140 may be bent at an angle of 60 degrees after primary bending and be bent at an angle of 90 degrees after secondary bending.

Preferably, punches used for bending of the frame 140 have a less curvature in secondary bending than that in primary bending. The frame 140 may be subjected to bending plural times, rather than a single time, using punches of different curvatures for primary bending and secondary bending. This stepwise bending may prevent damage to the bent portions 143 and 145, such as, for example, tearing of the bent portions 143 and 145.

A portion S2 of the first bent portion 143 or the second bent portion 145 facing the opening 101 may have a greater curvature than that of a portion S1 opposite to the opening 101. This is because the first bent portion 143 and the second bent portion 145 are formed by bending a single pipe.

More particularly, the first bent portion 143 and the second bent portion 145 may have recesses 143*a* and 145*a* indented inwardly from outer surfaces thereof. In this case, the recesses 143*a* and 145*a* are formed at locations having a relatively great curvature. In the present invention, in consideration of the fact that a hollow pipe is used to form the frame 140, the recesses 143*a* and 145*a* are indented inwardly from the outer surfaces of the frame 140 and damage to the frame 140, such as, for example, tearing of the frame 140 does not occur.

FIG. 9 is a perspective view showing the back of the container. A description with reference to FIG. 9 is as follows.

The container 100 allows user access through one side thereof facing the first storage region 2, i.e. through the back of the container 100.

The container 100 may include a cover 150 configured to open or close the back of the container 100. One side of the cover 150 may be pivotally rotatable and the other side of the cover 150 may be fixed to a coupling device 170 which may couple the cover 150 and the container 100 to each other. The cover 150 may generally take the form of a plate.

The cover 150 may have a plurality of slots 152. The slots 152 may allow cold air inside the cabinet 10 to move into the second storage region 52 therethrough in a state in which the container 100 closes the first storage region 2 defined in the cabinet 10. As such, cold air supplied into the first storage region 2 may move through the slots 152 even in a state in which the cover 150 closes the back of the container 100.

Accordingly, a sufficient amount of cold air may be supplied into a storage space defined in the door 20 as well as the second storage region 52, which may allow food to be stored fresh.

The cover 150 may be formed of a transparent material to allow the user to view food stored in the container 100 through the cover 150.

The container 100 may be provided at a position thereof facing the cover 150 with an elastic protrusion 148, the elastic protrusion 148 being configured to be pushed by the cover 150. The elastic protrusion 148 may be formed of a compression deformable material, such as rubber.

The elastic protrusion 148 may be kept compressed in a state in which the cover 150 closes the back of the container 100. Then, once the coupling device 170 releases coupling of the cover 150 and the container 100, the cover 150 is rotated by elastic restoration force of the elastic protrusion 148, thereby opening the second storage region 52.

FIG. 10 is an exploded perspective view of the coupling device for the cover. A description with reference to FIG. 10 is as follows.

The coupling device 170 includes an operating piece 172 that may be operated by the user and a hook 180 that may be selectively caught and fixed by the operating piece 172. In this case, as exemplarily shown in FIG. 9, the operating piece 172 may be installed to the container housing 110 and the hook 180 may be installed to the cover 150.

Meanwhile, the coupling device 170 may further include a first fixing element 176 and a second fixing element 174, which serve to fix the operating piece 172 to the container housing 110. In this case, the first fixing element 176 and the second fixing element 174 may movably fix the operating piece 172 to the container housing 110.

FIG. 11 is a view explaining operation of the coupling device. A description with reference to FIG. 11 is as follows. FIG. 11 is a sectional view taken along line A-A of FIG. 9.

In FIG. 11, (a) shows a state in which the operating piece 172 and the hook 180 are coupled to each other and the cover 150 is not rotatable relative to the container housing 110 and (b) shows a state in which coupling of the operating piece 172 and the hook 180 is released and the cover 150 is rotatable relative to the container housing 110.

More specifically, in a state in which the operating piece 172 is moved as exemplarily shown in (b) of FIG. 11, the hook 180 may be positioned to escape from the operating piece 172 through an aperture formed in the operating piece 172. Thus, in the state shown in (b) of FIG. 11, the user may grip and rotate the cover 150.

On the other hand, in a state shown in (a) of FIG. 11, the hook 180 cannot escape from the operating piece 172 through the aperture formed in the operating piece 172. Thus, the coupling device 170 may couple the container housing 110 and the cover 150 to each other.

FIG. 12 is a sectional view showing a state in which the container closes the first storage region and FIG. 13 is a top plan view of FIG. 12. A description with reference to FIGS. 12 and 13 is as follows.

The frame 140 is surrounded by the frame cover 103 and, thus, may be not exposed to the user. In this case, the frame cover 103 may be comprised of a first frame cover surrounding one side of the frame 140 and a second frame cover surrounding the other side of the frame 140. The first frame cover and the second frame cover are provided as separate components. Thus, the first frame cover and the second frame cover may be individually prefabricated and thereafter be coupled to each other to surround the frame 140.

The frame cover 103 may be provided with a raised portion 105 protruding in an outer circumferential direction thereof. The raised portion 105 may be configured to protrude toward the filler 62 to reduce a gap between the container 100 and the first storage region 2.

Meanwhile, by reducing a cross section of the frame 140 of the container 100, it is possible to provide the container 100 with a food storage space having a greater volume. Although a space for installation of the container 100 is limited, increasing a storage amount of food is possible by reducing a space occupied by the frame 140.

The filler 62 and a portion of the container 100 adjacent to the filler 62 must have a gap required for rotation of the container 100. This is because rotation of the container 100 is impossible when contact between the container 100 and the filler 62 occurs due to a narrow gap.

In the present invention, a required distance from the container 100 to the filler 62 may be easily achieved by reducing a cross section of the frame 140. For example, when a cross section of the frame 140 is increased and, thus, a thickness of a sidewall of the container 100 is increased, the container 100 must be spaced apart from the filler 62 by an increased distance in order to successively implement rotation. However, when a cross section of the frame 140 is reduced and, thus, a thickness of the sidewall of the container 100 is reduced, the container 100 may be located closer to the filler 62 without deterioration in rotation thereof.

In other words, through provision of the slim frame 140, it is possible to allow a space for storage of food to occupy most of the space of the container 100. In addition, as the thickness of the sidewall of the container 100 is reduced, there occurs less interference between the container 100 and the filler 62 during rotation of the container 100 and, consequently, a space for operation of the container 100 may be increased.

In addition, in the present invention, the raised portion 105 generally has a tapered shape to enable rotation of the container 100 even if a distance between the container 100 and the filler 62 is reduced.

The filler 62 is installed at the center of the first storage region 2 and comes into contact with the two doors 20 so as to hermetically seal a gap between the doors 20. More specifically, the filler 62 may come into contact with facing sides of the two doors 20 so as to hermetically seal the first storage region 2. Accordingly, one side of the right door 20 comes into contact with the cabinet 10 to hermetically seal the first storage region 2 and the other side of the right door 20 comes into contact with the filler 62 so as to hermetically seal the first storage region 2. The filler 62 is a component that is widely used in a case in which two doors are used to open or close a single storage compartment via rotation thereof and, thus, a detailed description thereof will be omitted herein.

In this case, the raised portion 105 may have a tapered cross section having a predetermined angle. When the container 100 hermetically seals the first storage region 2 under assistance of the raised portion 105, it is possible to reduce the amount of cold air to be discharged outward of the first storage region 2 through the container 100.

The raised portion 105 may be inclined to prevent increase in the thickness of the entire container 100. Thus, it is possible to minimize increase in the weight of the entire container 100 despite addition of the raised portion 105.

The raised portion 105 may be manufactured by gas assisted injection molding. In this case, the raised portion 105 may have a gas movement passage 106 formed therein for movement of gas during gas assisted injection molding. The gas movement passage 106 may extend by a long length in a height direction of the raised portion 105. The gas movement passage 106 may be not exposed outward of the raised portion 105, thus ensuring movement of gas within the raised portion 105 during injection molding.

In this case, the raised portion 105 may be integrally formed with the container 100. More specifically, the raised portion 105 may be manufactured simultaneously with manufacture of the frame cover 103. This may eliminate need for an additional structure to couple the raised portion 105 to the container 100.

Meanwhile, assuming that a refrigerator according to an embodiment of the present invention is configured such that the first storage region 2 is opened or closed by a single door, the filler 62 may be replaced by one side of the cabinet 10. In the embodiment in which the single storage compartment is opened or closed by the single door, no filler is necessary because the single door may come into contact at both sides thereof with the cabinet 10 to close the first storage region 2. That is, the present invention may be applied to not only an embodiment in which a single storage compartment is opened or closed by two doors, but also an embodiment in which a single storage compartment is opened or closed by a single door.

The frame 140, when viewed from the top as shown in FIG. 13, may include a front portion 140*a* facing the door, a rear portion 140*b* facing the first storage region 2, a first side portion 140*c* corresponding to the second storage region of the container and a second side portion 140*d* opposite to the first side portion facing the second storage region.

The frame cover 103 may include a front cover portion 1130 corresponding to the front portion 140*a* of the frame 140, a rear cover portion 1110 corresponding to the rear portion 140*b* of the frame 140, a first side cover portion 1130*a* corresponding to the first side portion 140*c* of the frame 140 and a second side cover portion 1130*b* corresponding to the second side portion 140*d* of the frame 140, the second side cover portion 1130*b* defining the outer circumference of the container.

In this case, a horizontal width W1 of the front cover portion 1130 may be greater than a horizontal width W2 of the rear cover portion 1110. When the container is rotated relative to the cabinet, the front cover portion 1130 causes less interference with the cabinet than the rear cover portion 1110 and, therefore, the front cover portion 1130 may have a greater width.

The rear cover portion 1110 may be provided with a door dike portion extending from the rear portion 140*b* of the frame 140 inward of the cabinet. In this case, the door dike portion may refer to the container housing 110.

The front cover portion 1130 may be provided with a gasket, the gasket being formed in an up-and-down direction of a second vertical portion that will be described hereinafter (as exemplarily shown in FIG. 14 in detail).

The second side cover portion 1130*b* may extend from one end of the front cover portion 1130 so as to be connected to one end of the rear cover portion 1110. In addition, the second side cover portion 1130*b* may be inclined such that a cross section of the frame cover 103 surrounding the second vertical portion is reduced inward of the cabinet.

The second side cover portion 1130*b* may have an elongated hole at a position adjacent to the front cover portion 1130, the elongated hole extending in an up-and-down direction of the second vertical portion. In this case, the elongated hole may refer to the gas movement passage 106.

Among the front cover portion 1130, the first and second side cover portions 1130*a* and 1130*b* and the rear cover portion 1110 of the frame cover 103, at least three portions may be integrally formed with one another by plastic injection molding and may be coupled to the other portion.

The first side cover portion 1130*a*, the front cover portion 1130 and the second side cover portion 1130*b* of the frame cover 103 may be integrally formed with one another by plastic injecting molding.

The front cover portion may include a gasket formed on an edge portion of the second side cover portion in an up-and-down direction of the second vertical portion toward an opposite direction of the first side portion of the frame.

In addition, a cross section of the second side cover portion may be reduced inward of the cabinet such that an outside surface of the second side portion is inclined.

FIGS. 14 and 15 are views respectively showing an embodiment different from FIGS. 12 and 13. A description with reference to FIGS. 14 and 15 is as follows.

As exemplarily shown in FIG. 14, the raised portion 105 may be formed in a length direction as well as a height direction of the container 100. That is, the raised portion 105 may be formed at two edges among outer circumferential edges of the container. 101. Of course, differently from illustration of FIG. 14, the raised portion 105 may be formed at all four edges of the container 100.

Meanwhile, the raised portion 105, as exemplarily shown in FIG. 15, may include a gasket 108 installed to the frame cover 103. In this case, the gasket 108 may be formed of rubber. Thus, even if the gasket 108 comes into contact with the filler 62, the gasket 108 may be deformed to close a gap between the cabinet 10 and the container 100.

The gasket 108 may have a predetermined thickness such that the gasket 108, which has been temporarily deformed by external force, returns to an original state thereof upon removal of the external force.

Meanwhile, the gasket 108 may be configured to be fitted into the frame cover 103, for example.

FIG. 16 is a sectional view showing a state in which the door and the container hermetically seal the cabinet. A description with reference to FIG. 16 is as follows.

A rotatable roller 190 may be installed at the bottom of the container 100. The roller 190 may implement rolling motion in contact with an inner case 1612 that defines the first storage region 2.

The container may further comprises a rotatable roller 190 at the bottom thereof.

More specifically, the roller 190 may guide movement of the container 100 when the container 100 enters the first storage region 2.

As exemplarily shown in FIG. 16, the roller 190 may be spaced apart from the inner case 1612 by a predetermined distance 1, rather than coming into contact with the inner case 1612, in a state in which food is not received in the container 100.

On the other hand, when food is received in the container 100, the container 100 is slightly tilted downward by the weight thereof. Thus, in this case, the roller 190 is moved downward in the same manner as the container 100. Thereby, the roller 190 comes into contact with the inner case 1612 and supports the container 100 upward, thereby preventing excessive sagging of the container 100.

The roller 190 may be installed to the container 100 only at a position opposite to the second hinge member 200. One side of the container 100 is coupled to the door 20 via the second hinge member 200 and the other side of the container 100 opposite to the second hinge member 200 corresponds to a free end. Thus, one side of the container 100 provided with the second hinge member 200 may exhibit less sagging by the weight of the container 100, whereas the other side of the container 100 not provided with the second hinge member 200 may exhibit greater sagging by the weight of the container 100. Accordingly, the roller 190 may be installed at a position where greater sagging occurs under the influence of the same weight.

FIG. 17 is a perspective view of the container and FIG. 18 is a view showing a basket of FIG. 17. A description with reference to FIGS. 17 and 18 is as follows.

The container 100 may include a first basket 186 for storage of food and a second basket 184 installed above the first basket 186. The second basket 184 may be movable in a width direction of the container 100.

More specifically, the second basket 184 is located above the first basket 186 and, thus, a height of food to be stored in the first basket 186 may be limited by the second basket 184. However, in the present invention, the second basket 184 is movable and, therefore, various heights of food may be stored in the first basket 186.

The container 100 may further include a third basket 182 installed above the second basket 184. The second basket 184 may be movably coupled to the third basket 182.

In this case, a first rail 192 may be installed to the bottom of the third basket 182 and a second rail 194 to be engaged with the first rail 192 may be installed to the top of the second basket 184. The first rail 192 may generally have an approximately "L"-shaped form and the second rail 194 may generally have an approximately "7"-shaped form. Thus, the second rail 194 may be engaged with the first rail 192 so as to be moved relative to the first rail 192.

Meanwhile, the first rail 192 and the second rail 194 may extend in a width direction of the container 100. In this case, a length of the second rail 194 may be less than a length of the first rail 192 such that a movement path of the second rail 194 is within a range of the length of the first rail 192.

FIG. 19 is a view showing a container according to another embodiment of the present invention, from which the container housing has been removed. FIG. 20 is an exploded perspective view of the container according to another embodiment. A description with reference to FIGS. 19 and 20 is as follows.

The container 100 includes the body 116 and the opening 101 formed in the center of the body 116. The body 116 may generally take the form of a rectangular band and the opening 101 may be located at the center of the body 116.

The frame cover includes a first frame cover 1110 forming an external appearance of the frame cover and a second frame cover 1130 coupled to the first frame cover 1110. The second frame cover 1130 is configured to close an open side of the first frame cover 1110 to prevent an inner region of the first frame cover 1110 from being partially exposed outward.

An inner space of the container 100, i.e. a space enclosed by the first frame cover 1110 and the second frame cover 1130 does not require an insulator. This is because the container 100 is simply received in the first storage region 2 rather than functioning to hermetically seal the first storage region 2 and the door 20 may achieve sufficient insulation of the first storage region 2. In addition, since the container 100 is received in the first storage region 2 when the door 20 is closed, insulation by the container 100 may be unnecessary.

The container 100 may internally define an empty space that is not provided with an insulator. The container 100 may generally have a rectangular shape and centrally defines an empty space.

More specifically, the container 100, which is not provided with an insulator and has a center empty region, may have less strength than that of the door 20.

The first frame cover 1110 may be provided in an inner space thereof with a structure to prevent the container 100 from sagging in a given direction. In this case, the frame 140 may be comprised of a first frame 1400 and a second frame 1140. A plurality of first frames 1400 may be coupled to one another and a plurality of second frames 1140 may be coupled to one another.

The second hinge member 200 may come into surface contact with and be coupled to the frame 140, i.e. the first frame 1400 and the second frame 1140. This may prevent deformation at a coupling region of the second hinge member 200 and the container 101. Since the frame 140 has greater strength than that of the frame cover, the second hinge member 200 is preferably coupled to the frame 140 rather than the frame cover.

In consideration of the fact that the first frame cover 1110 and the second frame cover 1130 are exposed to the user, the first frame cover 1110 and the second frame cover 1130 may be manufactured by injection molding a plastic material or the like. On the other hand, the frame 140 may be formed of a material having greater strength than that of the first frame cover 1110 and the second frame cover 1130, such as steel, aluminum or the like. That is, in the present invention, the second hinge member 200 may be coupled to a component having relatively high strength, in order to prevent deformation of the container 100.

In addition, the frame 140 may serve to increase inner strength of the container 100, thereby preventing the container 100 from being deformed by the weight of food received in the container 100. In addition, it is possible to prevent sagging of the container 100 due to the weight of the container 100 and the weight of food received in the container 100.

A plurality of frames 140 may be provided to extend in a longitudinal direction thereof and coupled to one another at one surface of the first frame cover 1110. That is, the plural frames 140 may configure elongated rods each extending in a given direction without a bent portion.

The plural frames 140 may be coupled to one another to define a structure having a rectangular shape similar to that of the container 100.

The frame 140 may be configured in such a manner that a portion of the frame 140 closer to a location to which the second hinge member 200 is coupled has a less cross sectional area than that of a portion of the frame 140 far from the coupling location of the second hinge member 200. That is, a portion of the frame 140 coupled to the second hinge member 200 (i.e. a right portion in FIG. 20) may have a less weight than that of a portion of the frame 140 far from the second hinge member 200 (i.e. a left portion in FIG. 20).

The weight of the container 100 is transferred to the door 20 and, in particular, is concentrated at the second hinge member 200. Greater moment occurs under condition of the same weight as a distance from the door 20, i.e. a distance from the second hinge member 200 increases. Meanwhile, since the frame 140 may be formed of a relatively high strength material, such as steel or the like, the frame 140 may be heavier than other members of the container 100. Accordingly, to reduce moment based on the weight of the frame 140, making a change in the shape of the frame 140 is possible.

More specifically, a portion of the frame 140 located far from the second hinge member 200 may be reduced in size for reduction in weight. On the other hand, a portion of the frame 140 close to the second hinge member 200 may be increased in size for increase in weight. Even if left and right portions of the frame 140 have different sizes, approximately the same moment may be generated because of a distance difference from the second hinge member 200.

With regard to this context, the first frame 1400 may have a cavity 1410 therein. The first frame 1400 having the cavity 1410 may be reduced in weight. Thus, sagging of the first frame 1400 may be reduced. A polygonal bar generally has no great change in deformation strength even if a cavity is formed in the polygonal bar. Therefore, the present invention has attempted to minimize force applied to the frame 140 by providing the interior of the first frame 1400, which is not a great help to strength, with an empty inner space.

In particular, the first frame 1400 may have a substantially rectangular cross section. That is, the first frame 1400 may have a polyhedral cross section to achieve sufficient strength. Although the present invention has proposed a rectangular cross section among various polyhedral cross sections, of course, the present invention is not limited to the rectangular cross section.

A plurality of second frames 1140 may be arranged at corners of the first frame cover 1110 respectively. Each of the second frames 1140 may be bent at an approximately right angle to extend in vertical and horizontal directions from the corner of the first frame cover 1110 by predetermined lengths. That is, differently from the first frames 1400 coupled to one another at angular points of the first frame cover 1110, the second frames 1140 serve as separate components at the angular points of the first frame cover 1110.

Instead, the plural second frames 1140 are coupled to one another at the middle of each segment of the first frame cover 1110. As such, coupling positions of the plural first frames 1400 and coupling positions of the plural second frames 1140 differ from each other.

Accordingly, strengths of the first frames 1400 and the second frames 140 may be complemented and increased by the different shapes and coupling positions of the first frames 1400 and the second frames 1140.

In particular, in consideration of the fact that coupling positions of the plural first frames 1400 are present at angular points of a rectangle, to enhance coupling force at the corresponding positions and to achieve sufficient strength, it is necessary to integrally form portions of the first frames 1400 corresponding to the angular points of the rectangle. To this end, the respective second frames 1140 may generally have an "L"-shaped form.

Meanwhile, each of the second frames 1140 may consist of a first extension portion 1142 surrounding one surface of the first frame 1400 and a second extension portion 1144 surrounding another surface of the first frame 1400. In this case, the first extension portion 1142 and the second extension portion 1144 may be arranged at a predetermined angle therebeween. More particularly, the first extension portion 1142 and the second extension portion 1144 may generally have an "L"-shaped form.

Through the above-described configuration, as the second frame 1140 is coupled to the first frame 1400 while coming into contact with plural surfaces of the first frame 1400, sufficient coupling force between the first frame 1400 and the second frame 1140 may be achieved. In terms of a single second frame 1140, the second frame 1140 comes into contact with and is coupled to a plurality of first frames 1400. In addition, the second frame 1140 is coupled to each first frame 1400 while coming into contact with plural surfaces of the single first frame 1400.

In this case, the first extension portion 1142 may face the second frame cover 1130 and the second extension portion 1144 may surround an inner circumferential surface of the first frame cover 1110.

The fixing device 500 may be installed to the top of the first frame cover 1110. The fixing device 500 may selectively come into contact with an inner ceiling surface of the first storage region 2 to selectively fix the container 100 in the first storage region 2.

The second hinge member 200 may include a rotating shaft 206 coupled to the door 20. The rotating shaft 206 is pivotally rotatably coupled to the door 20 to enable rotation of the container 100 about the rotating shaft 206.

The second hinge member 200 may include a first contact surface 202 that comes into contact with and is fixed to the first frame 1400 and a second contact surface 204 that comes into contact with and is fixed to the second frame 1140.

The first frame cover 1110 may have a coupling hole 1112, through which the first frame 1400 is exposed outward, and the second hinge member 200 may be coupled to the first frame 1400 through the coupling hole 1112. In this case, the first contact surface 202 of the second hinge member 200 may come into contact with the first frame 1400 to thereby be fixed to the first frame 1400.

The second frame cover 1130 may have a receiving groove 1134 indented therein and the second hinge member 200 may be coupled to the second frame 1140 in the receiving groove 1134. In this case, the second hinge member 200 may be fixed to the second frame 1140 as the second contact surface 204 thereof comes into contact with the second frame 1140. Meanwhile, a bracket may be installed between the receiving groove 1134 and the second hinge member 200 to fill an empty space that may be defined between the receiving groove 1134 and the second hinge member 200 for supplementation of strength.

In particular, the first contact surface 202 and the second contact surface 204 may be bent at a predetermined angle therebetween. That is, the second hinge member 200 may come into contact, at the first contact surface 202 and the second contact surface 204, with both the first frame 1400 and the second frame 1140 and, therefore, coupling force between the frame 140 and the second hinge member 200 may be increased.

Accordingly, the weight of the container 100 may be stably transferred to the door 20 via the second hinge member 200, which may prevent aggravation of sagging of the container 100 despite a connection structure of plural members.

Meanwhile, a total of two second hinge members 200 may be installed respectively at upper and lower positions of the container 100. The respective second hinge members 200 may have the same shape and differ only in terms of installation positions in relation to the container 100 and the door 20.

As exemplarily shown in FIG. 20, the container housing 110 is installed to the container 100. In this case, the container housing 110 is installed to face an inner space of the cabinet 10, i.e. to a surface of the container 100 facing the interior of the first storage region 2.

Meanwhile, a plurality of storage members, each defining the second storage region 52 for storage of food, may be installed to the container housing 110. In this case, the plural storage members may be installed at different heights to provide individual second storage regions 52 in which the user can store food. The storage members may take the form of baskets.

Meanwhile, the storage member may extend across the opening 101 of the body 116, which may increase the volume of a food storage space defined in the storage member. In addition, the storage member may be located in the opening 101 and fixed at both ends thereof by the body 116.

FIG. 21 is a view showing the frame of the body. A description with reference to FIG. 21 is as follows.

The first frames 1400 and the second frames 1140 may be coupled to one another to configure a framework of the body 116.

The plural first frames 1400 are coupled to one another with first coupling surfaces 1400*a* interposed therebetween. In this case, the first coupling surfaces 1400*a* are adjacent to angular points of the rectangular container 100.

The first frames 1400 have the cavity 1410 therein as described above and, therefore, may be prepared as plural discrete components for convenience of manufacture. In this case, to couple the respective first frames 1400 to one another, two first frames 1400 may first be aligned such that the first coupling surfaces 1400*a* thereof come into contact with each other and, thereafter, may be coupled to each other by welding or using various other means, such as bolts or the like.

In this case, the above-described configuration structure of the two first frames 1400 may cause poor strength at the first coupling surfaces 1400*a* or may aggravate sagging of the first frames 1400 at the first coupling surfaces 1400*a* thereof. For this reason, to overcome disadvantages caused at the first coupling surfaces 1400*a* of the two first frames 1400 coupled to each other, the second frame 1140 in the form of a single seamless member may be located adjacent to the first coupling surfaces 1400*a*.

The plural second frames 1140 are coupled to one another at second coupling surfaces 1140*a* thereof. In this case, the second coupling surfaces 1140*a* correspond to given positions of the container 100 except for the angular points thereof. Likewise, disadvantages that may be caused by the second coupling surfaces 1140*a* at which the plural second frames 1140 are coupled to one another may be overcome by the first frames 1400.

The second frames 1140 may be prepared as plural discrete components for convenience of manufacture. In this case, to couple the respective second frames 1140 to one another, two second frames 1140 may first be aligned such that the second coupling surfaces 1140*a* thereof come into contact with each other and, thereafter, may be coupled to each other by welding or using various other means, such as bolts or the like.

In this case, since positions of the first coupling surfaces 1400*a* and positions of the second coupling surfaces 1140*a* differ from each other, even if external force is applied to the first frames 1400 and the second frames 1140, it is possible to prevent the external force from being concentrated at positions corresponding to the first coupling surfaces 1400*a* and the second coupling surfaces 1140*a*, which may result in increased strength of the container 100. In this way, it is possible to prevent the container 100 from sagging in a given direction.

In addition, since the first frames 1400 and the second frames 1140 are coupled to one another as plural surfaces thereof come into contact with one another, the first frames 1400 and the second frames 1140 may maintain strong coupling therebetween.

More specifically, a single first frame 1400 may be coupled to a plurality of second frames 1140 and a single second frame 1140 may be coupled to a plurality of first frames 1400. As such, force applied to the single first frame 1400 may be distributed to the plural second frames 1140 and force applied to the single second frame 1140 may be distributed to the plural first frames 1400.

FIGS. 22 to 25 are views showing a coupling procedure of portion 'E' of the container shown in FIG. 19.

More specifically, FIG. 22 shows only the first frame cover 1110, FIG. 23 shows a state in which the first frame 1400 is coupled to the first frame cover 1110, FIG. 24 shows a state in which the first frame 1400 and the second frame 1140 are coupled to the first frame cover 1110, and FIG. 25 shows a state in which the first frame cover 1110, the first frame 1400, the second frame 1140 and the second frame cover 1130 are coupled to one another.

Referring to FIG. 22, a plurality of bosses 1114 protrudes from the first frame cover 1110 into an inner space of the first frame cover 1110. The bosses 1114 protrude from an inner surface of the first frame cover 1110 toward the open side of the first frame cover 1110. In this case, the bosses 1114 may protrude in a direction perpendicular to the inner surface of the first frame cover 1110.

Meanwhile, the first frame cover 1110 is provided at one side thereof with the coupling hole 1112 such that the first frame 1400 and the second hinge member 200 are coupled to each other through the coupling hole 1112. The coupling hole 1112 allows the inner space of the first frame cover 1110 to be exposed outward through an aperture rather than the open side. As such, the second hinge member 200 may be directly coupled to the first frame 1400.

Referring to FIG. 23, the first frame 1400 and the first frame cover 1110 may be coupled to each other as the bosses 1114 are inserted into through-holes 1400*b* of the first frame 1400. The first frame 1400 may be fixed to the first frame cover 1110 as one surface of the first frame cover 1110 comes into contact with one surface of the first frame 1400.

Referring to FIG. 24, the first frame 1400 and the second frame 1140 may be fixed to each other by coming into contact with each other. In this case, the first frame 1400 and the second frame 1140 may be fixed by welding.

Referring to FIG. 25, the second frame cover 1130 is coupled to the first frame cover 1110 to close the open side of the first frame cover 1110. In this case, this coupling may be completed as the bosses of the first frame cover 1110 are inserted into the second frame cover 1130.

FIG. 26 is a sectional view taken along line A-A of FIG. 19, FIG. 27 is a sectional view taken along line B-B of FIG. 19, FIG. 28 is a sectional view taken along line C-C of FIG. 19, and FIG. 29 is a sectional view taken along line D-D of FIG. 19. A description with reference to FIGS. 26 to 29 is as follows.

The bosses 1114 are inserted into and fixed in the cavity 1410 of the first frame 1400 and, therefore, the bosses 1114 may be received in the cavity 1410. As such, it is unnecessary to provide a space for installation of the bosses 1114 that are components for coupling between the first frame 1400 and the first frame cover 1110. Accordingly, a space required for the first frame 1400 and the bosses 1114 is reduced, which may prevent increase in the volume of the entire container 100.

In addition, the first frame 1400 may be received in a space defined by the frame covers 1130 and 1110. In this case, the first frame 1400 may be enclosed in an empty space that is not filled with an insulator. Since the container 100 is a structure provided under the assumption that the container 100 is received in the first storage region 2, it is unnecessary to consider insulation effects by the frame. Accordingly, it is unnecessary to increase sealing efficiency of the space defined by the frame covers or to fill the space defined by the frame covers with an insulator for acquisition of insulation effects. In conclusion, design and manufacture of the frame may be simplified and the weight of the frame may be reduced.

Meanwhile, as the first extension portion 1142 and the second extension portion 1144 of the second frame 1140 are arranged to surround plural surfaces of the first frame 1400, a contact area for coupling of the first frame 1400 and the second frame 1140 may be increased. Thus, even if force is applied to each of the first frame 1400 and the second frame 1140, the applied force may be distributed to and supported by a plurality of components. In this way, it is possible to prevent deformation of the container 100 even if great force is applied to a specific region.

Although not shown, the container housing 110 is installed at the right side of FIG. 26 (i.e. at a portion of the container 100 not provided with the second frame cover 1130. As such, the first frame 1400 and the second frame 1140 may be configured to be deviated to the container housing 110.

Among force applied to the container 100, the greatest force may be the weight of food placed in the storage region 52 of the container housing 110. By deviating the first frame 1400 and the second frame 1140, which serve to increase strength of the container 100, to the container housing 110 on the basis of the container 100, more particularly, to the first frame cover 1110, it is possible to stably support force applied to the storage region 52.

FIGS. 30 and 31 are views explaining the concept of the frame according to the present invention. A description with reference to FIGS. 30 and 31 is as follows.

Referring to FIG. 30, the frame 140 may include the first member 142 forming a lower side, the second member 144 located at one end of the first member 142 to extend perpendicular to the first member 142, a third member 146 located at one end of the second member 144 to extend perpendicular to the second member 144 and a fourth member 147 oriented perpendicular to the first member 142.

The fourth member 147 may include the two hinge couplers 120 to which the two second hinge members are coupled respectively.

Meanwhile, the third member 146 may be divided into a third member 146*b* located relatively close to the fourth member 147 and a third member 146*a* located relatively far from the fourth member 147.

In addition, the first member 142 may be divided into a first member 142*b* located relatively close to the fourth member 147 and a first member 142*a* located relatively far from the fourth member 147.

That is, coupling seams of the frame 140 may be located at the third member 146 and the first member 142.

Since each of the first member 142 and the third member 146 is divided into two members coupled to each other at the coupling seam, the first member 142 or the third member 146 may have poor strength as compared to a case in which it takes the form of a single seamless member. To solve this problem, a position of the coupling seam may be determined in such a manner that a distance D2 from the fourth member 147 to the coupling seam is less than a distance D1 from the second member 144 to the coupling seam. In other words, a position of the coupling seam of the first member 142 or the third member 146 may be deviated from the center of the first member 142 or the third member 146 to the fourth member 147.

Since the fourth member 147 includes the hinge couplers 120 and force applied to the frame 140 is transferred to the door 20 through the hinge couplers 120, moment about the hinge coupler 120 occurs.

Accordingly, greater moment occurs under condition of the same force with increasing distance from the hinge coupler 120, which may disadvantageously aggravate sagging of the frame 140.

For this season, the present invention has proposed a technical consideration to achieve less sagging of the frame 140 even if the same force is applied by setting coupling seams of the frame 140 in the form of an assembly to positions close to the hinge coupler 120.

Referring to FIG. 31, similar to FIG. 30, the frame 140 may consist of the first member 142, the second member 144, the third member 146 and the fourth member 147.

In this case, the fourth member 147 generally consists of three components and coupling of the respective components may be accomplished within a longitudinal range of the fourth member 147.

Among the three components of the fourth member 147, an uppermost fourth member 147*a* may extend perpendicular to the third member 146 and may be formed by bending one end of the third member 146.

In addition, among the three components of the fourth member 147, a lowermost fourth member 147*c* may extend perpendicular to the first member 142 and may be formed by bending one end of the first member 142.

The hinge couplers 120 may be installed respectively to the fourth members 147*a* and 147*c* and the other component of the fourth member, i.e. an intermediate fourth member 147*b* may be interposed between the hinge couplers 120. Meanwhile, the two hinge couplers 120 and the intermediate fourth member 147*b* may be integrated with one another to form a single member.

The hinge coupler 120 is a component coupled to the second hinge member 200. As the two hinge couplers 120 are provided, the weight of the container 100 may be transferred to the door 20 via the two hinge couplers 120. As such, the total weight of the container 100 is concentrated at the hinge couplers 120.

Accordingly, the hinge couplers 120 are preferably spaced apart from each other by a relatively long distance rather than being gathered at a single position.

More specifically, a height H1 from the vertical center of the hinge coupler 120 to the third member 146 may be less than a height H2 from the vertical center of the hinge coupler 120 to the vertical center of the frame 140.

That is, the hinge couplers 120 may be deviated respectively to the top and bottom of the frame 140 on the basis of the vertical center of the frame 140.

As a result of positioning the hinge couplers 120 far from the vertical center of the frame 140, it is possible to distribute force applied to the container 100 to the respective hinge couplers 120. In addition, owing to a relatively long distance between the two hinge couplers 120, it is possible to prevent force applied to the frame 140 from being concentrated at a single position.

Accordingly, even if the same force is applied to the container 100, less sagging of the container 100 may occur.

The refrigerator of the present invention may generally include the cabinet 10 having at least one storage compartment in which food is stored, the first hinge member 40 supported by the cabinet 10, at least one door 20 configured to open or close the storage compartment, the door 20 being connected to the first hinge member 40 so as to be rotatable relative to the cabinet 10, the door 20 having the gasket 26 attached to an inner surface thereof, the gasket 26 defining a sealing boundary to prevent leakage of cold air from the storage compartment, the container 100 configured to define an auxiliary storage region separated from the storage compartment, the container 100 being received in the storage compartment of the cabinet 10 and being pivotally rotatable along with the door 20 or independently of the door 20 at a position separated from the cabinet 10, and the second hinge member 200 configured to support the container 100 so as to be pivotally rotatable relative to the door 20. The container 100 may be located inside the sealing boundary when the door 20 is closed. The gasket 26 of the door 20 may come into close contact with a front surface of the cabinet 10 to seal the storage compartment of the cabinet 10 as well as the auxiliary storage region of the container 100. The container 100 may include the metal frame 140 configured to support the auxiliary storage region and the frame cover 103 configured to surround the frame 140. The frame 140 may include at least one horizontal portion, at least one vertical portion and at least one integrated horizontal and vertical part configured to integrally connect the horizontal portion and the vertical portion to each other.

In this case, the horizontal portion may refer to a member installed in a horizontal direction of the frame 140, i.e. the first member 142 or the third member 146 and the vertical portion may refer to a member installed in a vertical direction of the frame 140, i.e. the second member 144 or the fourth member 147, without being limited thereto.

The integrated horizontal and vertical part may refer to a portion for division of the first member, the second member, the third member and the fourth member, i.e. each angular point of a rectangle.

In particular, the integrated horizontal and vertical part may include a bent portion formed by bending a hollow metal frame. The integrated horizontal and vertical part may be formed by metal die casting.

The integrated horizontal and vertical part may include a bent portion formed by bending a metal frame, the metal frame having one or more planes perpendicular to each other.

The frame may include a first vertical portion coupled to the second hinge member, a second vertical portion arranged to face the first vertical portion, the second vertical portion supporting the auxiliary storage region, a first horizontal portion inter-connecting upper ends of the first vertical portion and the second vertical portion and a second horizontal portion interconnecting lower ends of the first vertical portion and the second vertical portion.

The second vertical portion may have a hollow shape, be formed of a metal and take the form of a unitary member. In addition, the second vertical portion may be configured to be unitary as a whole with hollow shaped metal material.

As exemplarily shown in FIG. 30, the first horizontal portion or the second horizontal portion may be formed of two members, the frame may include a coupling portion at which the two first horizontal portions or the two second horizontal portions are coupled to each other, and a horizontal distance from the first vertical portion to the coupling portion may be equal to or less than a horizontal distance from the first vertical portion to the center of the first horizontal portions or the second horizontal portions.

The first vertical portion may include a plurality of members and at least one connecting portion coupled to the plural members, and the connecting portion may be positioned so as to be deviated to the upper end or the lower end of the first vertical portion.

The connecting portion may be positioned closer to the upper end or the lower end of the first vertical portion than to a center of the first vertical portion in a vertical direction.

In particular, as exemplarily shown in FIG. 31, the first vertical portion may include a connecting portion connected to at least one member, and a vertical distance from the first horizontal portion or the second horizontal portion to the connecting portion may be equal to or less than a vertical distance from the center of the first vertical portion to the connecting portion.

The integrated horizontal and vertical part may be formed at a corner where the second vertical portion meets with the first horizontal portion or the second horizontal portion. In this case, the integrated horizontal and vertical part may include a bent portion formed by bending a hollow metal.

The second vertical portion may have a hollow shape, be formed of a metal and take the form of a unitary member.

The integrated horizontal and vertical part may include a bent portion formed by bending a metal member, the metal member having one or more planes perpendicular to each other, and the first horizontal portion, the second horizontal portion and the second vertical portion may include hollow metal rod-shaped members, and the bent portion may be installed at a location where the rod-shaped member of the second vertical portion meets with the rod-shaped member of the first horizontal portion or the rod-shaped member of the second horizontal portion.

The second vertical portion may take the form of a single rod-shaped member.

The integrated horizontal and vertical part may be formed at a corner where the first vertical portion meets with the first horizontal portion or the second horizontal portion.

The integrated horizontal and vertical part may be formed by metal die casting. Thereby, it is possible to provide the integrated horizontal and vertical part with sufficient strength.

The second hinge member may be fixed to the integrated horizontal and vertical part.

The integrated horizontal and vertical part may include a bent portion formed by bending a metal member, the metal member having one or more planes perpendicular to each other, and the first horizontal portion, the second horizontal portion and the first vertical portion may include hollow metal rod-shaped members, and the bent portion is installed at a location where the rod-shaped member of the first vertical portion meets with the rod-shaped member of the first horizontal portion or the rod-shaped member of the second horizontal portion.

The first vertical portion may take the form of a single rod-shaped member.

The bent portion installed at the location where the rod-shaped member of the first vertical portion and the rod-shaped member of the first horizontal portion meet each other and the bent portion installed at the location where the rod-shaped member of the first vertical portion and the rod-shaped member of the second horizontal portion meet each other may be integrally formed portions.

The first vertical portion may further include a hollow rod-shaped member and is integrally coupled to the integrated horizontal and vertical part, the integrated horizontal and vertical part being formed by metal die casting.

In addition, according to an embodiment of the present invention, the refrigerator may include a cabinet having at least one storage compartment in which food is stored, a first hinge member supported by the cabinet, at least one door configured to open or close the storage compartment, the door being connected to the first hinge member so as to be rotatable relative to the cabinet, the door having a gasket attached to an inner surface thereof, the gasket defining a sealing boundary to prevent leakage of cold air from the storage compartment, a container configured to define an auxiliary storage region separated from the storage compartment, the container being received in the storage compartment of the cabinet and being pivotally rotatable along with the door or independently of the door at a position separated from the cabinet, and a second hinge member configured to support the container so as to be pivotally rotatable relative to the door. The container may include a frame configured to support the auxiliary storage region and a frame cover configured to surround the frame, the frame may include a first vertical portion coupled to the second hinge member and a second vertical portion arranged to face the first vertical portion, the second vertical portion supporting the auxiliary storage region, and the first vertical portion may have a greater weight than a weight of the second vertical portion such that a center of gravity of the frame is deviated to the first vertical portion coupled to the second hinge member.

The first vertical portion may have a greater cross sectional area than a cross sectional area of the second vertical portion.

The first vertical portion and the second vertical portion may be formed of a metal, the first vertical portion includes at least a portion formed by metal die casting, and the second vertical portion includes a hollow metal frame.

In addition, according to an embodiment of the present invention, the refrigerator may include a cabinet having at least one storage compartment in which food is stored, a first hinge member supported by the cabinet, at least one door configured to open or close the storage compartment, the door being connected to the first hinge member so as to be rotatable relative to the cabinet, the door having a gasket attached to an inner surface thereof, the gasket defining a sealing boundary to prevent leakage of cold air from the storage compartment, a container configured to define an auxiliary storage region separated from the storage compartment, the container being received in the storage compartment of the cabinet and being pivotally rotatable along with the door or independently of the door at a position separated from the cabinet, and a second hinge member configured to support the container so as to be pivotally rotatable relative to the door. The container may be located inside the sealing boundary when the door is closed, and the gasket of the door may come into close contact with a front surface of the cabinet to simultaneously seal the storage compartment of the cabinet and the auxiliary storage region of the container, the container may include a metal frame configured to support the auxiliary storage region and a plastic frame cover configured to surround the frame, and the frame may include a first vertical portion coupled to the second hinge member and a second vertical portion arranged to face the first vertical portion, the second vertical portion supporting the auxiliary storage region, and a distance from one vertical end of the first vertical portion to the second hinge member may be less than a distance from a vertical center of the first vertical portion to the second hinge member (see FIG. 31).

The frame may include at least one horizontal portion interconnecting the first vertical portion and the second vertical portion to each other, and the frame may further include at least one integrated horizontal and vertical part formed by integrally connecting the horizontal portion and the vertical portion to each other at a location where the first vertical portion or the second vertical portion is connected to the horizontal portion.

The integrated horizontal and vertical part connected to the first vertical portion may be formed by metal die casting, and the second hinge member may be fixed to the portion formed by metal die casting.

The integrated horizontal and vertical part connected to the second vertical portion may be formed of a hollow metal rod.

The frame may include a first horizontal portion interconnecting upper ends of the first vertical portion and the second vertical portion and a second horizontal portion interconnecting lower ends of the first vertical portion and the second vertical portion, and the second vertical portion may be a unitary portion in the form of a hollow metal rod and both ends of the second vertical portion are bent to form a portion of the first horizontal portion and a portion of the second horizontal portion, and the first vertical portion may include a metal rod-shaped member having a cavity, the metal rod-shaped member being located at the center of the first vertical portion, and integrated horizontal and vertical parts integrally formed with a portion of the first horizontal portion and a portion of the second horizontal portion respectively, the integrated horizontal and vertical parts being located at both ends of the first vertical portion, and the rod-shaped member and the integrated horizontal and vertical part may be coupled to each other.

The integrated horizontal and vertical parts may be formed by metal die casting.

An embodiment of a refrigerator according to the present application may comprises: a cabinet configured to define a first storage region in which food is stored; a door connected to the cabinet via a first hinge member having a first rotating shaft located at the front of the cabinet to open or close the first storage region, the door being rotatable relative to the cabinet; a gasket provided at the door; and a container configured to define a second storage region, the second storage region being received in the first storage region, the container being rotatably connected to the door via a second hinge member having a second rotating shaft, the second rotating shaft being located at the door, wherein the container includes a centrally formed opening and a body configured to define a periphery of the opening in a rectangular form, wherein the body includes a frame and a frame cover configured to surround the frame, wherein the frame includes a first member defining a lower side, a second member placed at one end of the first member to extend perpendicular to the first member, a third member placed at one end of the second member to extend perpendicular to the second member and a fourth member placed perpendicular to the first member, wherein the second hinge member is installed to the fourth member, and wherein the first member, the second member and the third member are integrally formed with one another.

In addition the integrated horizontal and vertical part may include a bent portion formed by metal material, the bent portion having one or more planes perpendicular to each other, and the first horizontal portion, the second horizontal portion and the second vertical portion may be configured to be a rod-shaped hollow metal, and the bent portion may be installed at a location where the rod-shaped second vertical portion meets with the rod-shaped first horizontal portion or the rod-shaped second horizontal portion.

The second vertical portion may be configured to form a single rod-shaped member.

The integrated horizontal and vertical part may be formed at a corner where the first vertical portion meets the first horizontal portion or the second horizontal portion.

The integrated horizontal and vertical part may be formed by metal die casting.

The second hinge member may be fixed to the integrated horizontal and vertical part.

The integrated horizontal and vertical part may include a bent portion formed by metal material, the metal member having one or more planes perpendicular to each other, and the first horizontal portion, the second horizontal portion and the first vertical portion may be configured to be a rod-shaped hollow metal, and the bent portion may be installed at a location where the rod-shaped first vertical portion meets the rod-shaped first horizontal portion or the rod-shaped second horizontal portion.

The first vertical portion may be configured to form a single rod-shaped member.

The bent portion installed at the location where the rod-shaped first vertical portion and the rod-shaped first horizontal portion meet each other and the bent portion installed at the location where the rod-shaped first vertical portion and the rod-shaped second horizontal portion meet each other may be integrally formed.

The present invention should not be construed as limited to the embodiments set forth herein. It should be understood that various modifications can be made by those skilled in the art within the spirit and scope of the invention as defined by the claims and these modifications should not be understood independently of the technical sprit or prospect of the invention.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a refrigerator.

The invention claimed is:

1. A refrigerator comprising:

a cabinet;

a storage compartment provided in the cabinet and configured to store food therein;

a container provided to be rotatable relative to the cabinet and configured to open and close the storage compartment to selectively provide access to items in the storage compartment, the container comprising an opening formed in a center thereof;

a door rotatably provided on the container and configured to be rotatable relative to the container and to the cabinet, and to open and close the opening in the container; and a fastening device disposed at the door and configured to selectively couple the door to the container and to release the door from the container, the fastening device being configured to couple the door to the container to allow the door and the container to rotate together and to release the door from the container to allow the door to rotate relative to the container, wherein the container comprises a frame cover and a frame provided inside the frame cover, wherein the frame comprises:

horizontal portions respectively forming an upper side and a lower side of the frame;

vertical portions provided perpendicular to the horizontal portions and respectively forming a left side and a right side of the frame; and an integrated horizontal and vertical portion that is configured to couple one of the horizontal portions and one of the vertical portions to each other, wherein the integrated horizontal and vertical portion comprises a first coupling portion that extends horizontally, and a second coupling portion arranged perpendicular to the first coupling portion, wherein the vertical portions and the horizontal portions of the frame comprise hollow regions, respectively, and the first coupling portion and the second coupling portion of the integrated horizontal and vertical portion are inserted into and coupled to the hollow regions of the one of the horizontal portions and the one of the vertical portions of the frame, wherein the one of the horizontal portions and the one of the vertical portions each have a cross section that forms a closed curve around the corresponding hollow region, and wherein each of the first coupling portion and the second coupling portion has a shape corresponding to the closed curve.

2. The refrigerator according to claim 1, wherein the integrated horizontal and vertical portion comprises a curved portion between the second coupling portion and the first coupling portion that comprises a bent hollow metal frame.

3. The refrigerator according to claim 1, wherein the integrated horizontal and vertical portion further comprises a curved portion between the second coupling portion and the first coupling portion that forms a vertex of the frame of the container.

4. The refrigerator according to claim 1, wherein the hollow regions of the one of the horizontal portions and the one of the vertical portions of the frame comprise:

a first opening at the one of the horizontal portions into which the first coupling portion of the integrated horizontal and vertical portion is configured to be inserted; and a second opening at the one of the vertical portions into which the second coupling portion of the integrated horizontal and vertical portion is configured to be inserted.

5. The refrigerator according to claim 4, wherein the first opening is formed at an end of the one of the horizontal portions and is configured to receive the first coupling portion of the integrated horizontal and vertical portion along a longitudinal direction of the one of the horizontal portions; and wherein the second opening is formed at an end of the one of the vertical portions and configured to receive the second coupling portion of the integrated horizontal and vertical portion along a longitudinal direction of the one of the vertical portions.

6. The refrigerator according to claim 1, wherein the integrated horizontal and vertical portion has a solid interior.

7. The refrigerator according to claim 6, wherein the solid interior of the integrated horizontal and vertical portion is formed at least in the first coupling portion and in the second coupling portion of the integrated horizontal and vertical portion.

8. The refrigerator according to claim 1, wherein the horizontal portions of the frame comprise a first member forming the lower side of the frame and a third member forming the upper side of the frame, and wherein the vertical portions of the frame comprise a second member forming the left side of the frame and a fourth member forming the right side of the frame.

9. The refrigerator according to claim 8, wherein the first member, the second member, the third member, and the fourth member collectively form four respective sides of the frame.

10. The refrigerator according to claim 1, wherein at least one of the hollow regions of the horizontal portions and the vertical portions has a polygonal cross-sectional shape.

11. The refrigerator according to claim 1, wherein the first coupling portion and the second coupling portion of the integrated horizontal and vertical portion each have an angled cross-sectional shape in a polygonal shape.

12. The refrigerator according to claim 1, wherein a horizontal distance from the one of the vertical portions to an end of the first coupling portion of the integrated horizontal and vertical portion is equal to or less than a horizontal distance from the one of the vertical portions to a center of the one of the horizontal portions.

13. The refrigerator according to claim 1, wherein a vertical distance from the one of the horizontal portions to an end of the second coupling portion of the integrated horizontal and vertical portion is equal to or less than a vertical distance from the one of the horizontal portions to a center of the one of the vertical portions.

14. The refrigerator according to claim 1, wherein the frame is formed of a metal material and is manufactured by a bending process.

15. The refrigerator according to claim 1, wherein the frame comprises a curved portion having a predetermined curvature and that forms a vertex of the frame.

16. The refrigerator according to claim 1, further comprising a basket provided to extend across the opening of the container, with opposite ends of the basket being fixed.

17. The refrigerator according to claim 1, wherein the frame cover of the container surrounds the frame of the container and prevents the frame from being exposed to an outside of the refrigerator.

18. The refrigerator according to claim 1, wherein the frame and the frame cover of the container are formed of different materials, and wherein the frame is formed of a first material having a higher strength than a second material of the frame cover.

19. The refrigerator according to claim 1, wherein the first coupling portion is inserted into the hollow region of the one of the horizontal portions and surrounded by the one of the horizontal portions, and wherein the second coupling portion is inserted into the hollow region of the one of the vertical portions and surrounded by the one of the vertical portions.

* * * * *